US007508304B2

(12) United States Patent
Swanson

(10) Patent No.: US 7,508,304 B2
(45) Date of Patent: Mar. 24, 2009

(54) NETWORKED MULTIBAND WAVEGUIDE INTRUSION DETECTION AND LOCALIZATION SENSOR

(75) Inventor: David C. Swanson, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 149 days.

(21) Appl. No.: 11/426,952

(22) Filed: Jun. 28, 2006

(65) Prior Publication Data

US 2007/0008123 A1 Jan. 11, 2007

Related U.S. Application Data

(60) Provisional application No. 60/696,879, filed on Jul. 6, 2005.

(51) Int. Cl.
*G08B 21/00* (2006.01)

(52) U.S. Cl. ..... 340/541; 340/566; 340/561; 340/668

(58) Field of Classification Search ..... 340/566, 340/561, 668, 552, 541, 568, 691, 522, 506, 340/511, 517, 565; 702/69
See application file for complete search history.

(56) References Cited

U.S. PATENT DOCUMENTS 4,227,188 A 10/1980 Petersen
4,289,287 A 9/1981 Child et al.
4,829,287 A 5/1989 Kerr et al.
4,879,544 A 11/1989 Maki et al.
5,610,583 A * 3/1997 Drebika et al. ..... 340/566
5,914,655 A * 6/1999 Clifton et al. ..... 340/506
6,127,926 A * 10/2000 Dando ..... 340/541
6,661,340 B1 * 12/2003 Saylor et al. ..... 340/517
6,731,210 B2 * 5/2004 Swanson et al. ..... 340/566
7,069,160 B2 * 6/2006 Cecil ..... 702/59
7,184,907 B2 * 2/2007 Chun ..... 702/69

OTHER PUBLICATIONS

PCT/US06/25258, International Search Report, The Pennsylvania State Research Foundation, Priority date Jul. 6, 2005, 2 pages.

* cited by examiner

*Primary Examiner*—Benjamin C Lee
*Assistant Examiner*—Hoi C Lau
(74) *Attorney, Agent, or Firm*—McKee, Voorhees & Sease, P.L.C.

(57) ABSTRACT

A vibration detection and/or classification system includes a waveguide in operative contact with a boundary, at least one sensor for sensing vibrations operatively connected to the waveguide and providing a signal, and a control circuit operatively connected to the at least one sensor and adapted for filtering the signal into a plurality of frequency bands and detecting and classifying vibrations. The control circuit may be further adapted for detecting and classifying vibrations to determine if the boundary has been crossed by an intruder. The control circuit may include a transceiver for sending signals to a central computer for processing, such as via a radio modem.

26 Claims, 18 Drawing Sheets

Fused position is weighted by inverse total error:

$$X_f = \frac{\sum_i \frac{1}{\Delta_i} X_i}{\sum_i \frac{1}{\Delta_i}} \qquad \Delta_i = \Delta_i^L + \Delta_i^R$$

Left and Right Errors Averaged:

$$\Delta_f^L = \frac{1}{N} \sum_{i=1}^{N} \Delta_i^L$$

$$\Delta_f^R = \frac{1}{N} \sum_{i=1}^{N} \Delta_i^R$$

NETWORKED MULTIBAND WAVEGUIDE INTRUSION DETECTION AND LOCALIZATION SENSOR

RELATED APPLICATIONS

This application claims priority to U.S. Provisional Patent Application No. 60/696,879, filed Jul. 6, 2006, hereby incorporated by reference in its entirety.

BACKGROUND OF THE INVENTION

This invention relates to a system and methods for monitoring of boundaries. More specifically, but without limitation, this invention relates to a security system that transmits vibrations along a waveguide and then senses the vibrations to detect, localize, and/or classify the vibration.

The prior art discloses a number of different means to detect intrusions or other disturbances in a fence or other boundary. One common method is to use taut wire systems. One example of a taut wire system is disclosed in U.S. Pat. No. 4,829,287 to Kerr et al. In such a taut wire system, sensors such as pressure sensors or strain gauges are used to sense changes in the tension of the wire. In this and other systems, because tension is being sensed, a number of sensors are required along the fence to ensure that an intrusion does not go undetected. If there is too great of distance between sensors, then added tension due to an intrusion may go unnoticed. A specially-designed fence for use in a taut wire system may have integrated strain gauges to detect stress changes and vibrations from climbing. This type of system is very expensive to build and especially to maintain. Also, wind, rain, and thermal expansion and contraction cause false alarms. Thus there are numerous potential problems with this approach.

Another example of a prior art approach is to use direct vibration sensors such as geophones. A geophone is attached to the chain-link fence fabric every 20 to 30 feet and wired together in parallel. Using direct vibration sensors such as geophones is very expensive, sensitive to sensor failure, easily vandalized, cannot localize, and has false alarms from environmental noise.

Yet another type of system uses active microwave waveguides. This type of system uses a leaky coaxial cable and an active microwave pulse transmitter to monitor the reflection response along a segment of fence where the cable is woven into a "zig-zag" pattern in the fence fabric. Any change in the fence stress or vibration changes the microwave echo pattern, thus allowing a detection and localization. The shortcomings of this approach are the exposure to vandalism, expense, and maintenance. One example of a leaky coaxial cable system is disclosed in U.S. Pat. No. 4,879,544 to Maki et al. In such a system, two cables are run parallel to one another, one acting as a transmitter, the other acting as a receiver. When the radio frequency signal leaks from the transmitter cable to the receiver cable, a field is created between the two cables. The changes in the field are monitored to determine if an intrusion has occurred. If the cable is cut, then this type of system fails to work and requires repair.

Another type of system uses fiber optic cables. Fiber optic intrusion detection (FOIDS) uses a laser and optical fiber where the interference pattern of the fiber reflections and the laser produce a sensor with very high sensitivity to both stress and vibration. The fiber is woven into the fence fabric and is easily vandalized as well as exposed to environmental degradation. FOIDS suffers from significant false alarms due to its sensitivity and cannot localize within a segment of fiber.

U.S. Pat. No. 6,731,210 to Swanson et al, herein incorporated by reference in its entirety, discloses a fence security system that uses a waveguide made of a simple wire with sensors that process the acoustics wave to localize the intrusion. Swanson et al teaches localization based on time of arrival as well as amplitude. Thus, although Swanson et al may be advantageous over other approaches, problems remain. In particular, what is needed is a simple way to calibrate and localize intrusions, improved immunity to wind and rain noise, improved rejection of nuisance alarms, and reduced localization error.

BRIEF SUMMARY OF THE INVENTION

Thus, it is a primary object, feature, or advantage of the present invention to provide a method and system for detecting, localizing, or classifying a disturbance that improves upon the state of the art.

It is a further object, feature or advantage of the present invention to provide for sensor electronics that are common for applications ranging from very small perimeters (such as, but not limited to swimming pools) to huge regions (such as, but not limited to, airport, sea ports, warehouse complexes, national borders).

A further object, feature, or advantage of the present invention is to provide for a system that can be reconfigured via software for different applications.

A still further object, feature, or advantage of the present invention is to provide for a large application of a security fence that can be facilitated using commercial wired or wireless Ethernet for a virtually unlimited number of sensing nodes and secure remote monitoring.

Another object, feature, or advantage of the present invention is provide for intrusion detection and localization in a manner that is resistant to wind and rain noise.

Yet another object, feature, or advantage of the present invention is to corroborate intrusion detection and localization and to provide a meaningful localization error estimate.

A further object, feature, or advantage of the present invention is to use an intrusion classification algorithm that rejects nuisance alarms from wind, rain, or fence thermal expansion and contraction.

A still further object, feature, or advantage of the present invention is to provide for an intrusion detection and localization for fence that is relatively inexpensive.

Another object of the present invention is to provide for a method and system for detecting, localizing, or classifying a disturbance that effectively extends the range of an acoustic or vibration sensor thus reducing the number of sensors required.

A further object of the present invention is to provide a method and system for detecting, localizing, or classifying a disturbance that is easily repairable and minimizes down time.

Yet another object of the present invention is to provide a method and system for a security system that can be implemented either above ground or underground.

Another object of the present invention is to provide for a method and system for detecting, localizing, or classifying a disturbance that is compatible with irregularly shaped fences or other boundaries.

Another object of the present invention is to provide for a method and system for detecting, localizing, or classifying a disturbance that is flexible in implementation and application such that both large areas or small areas can be detected.

Another object of the present invention is to provide for a method and system for detecting, localizing, or classifying a disturbance that is reliable.

Another object of the present invention is to provide for a method and system for detecting, localizing, or classifying a disturbance that is low in cost.

One or more of these and/or other objects, features, or advantages of the present invention will become apparent from the specification and claims that follow.

The present invention contemplates numerous applications and varying levels of complexities of security systems that can be implemented. For example, one application of the present invention is suitable to secure fences along national borders, military installations, airports, or other large areas. In such an application, more complex sensing systems and processing can be used for enhanced localization and classification of a disturbance. Additional alarm or alert systems can also be used in such a system. The present invention is also suitable for smaller and/or less sophisticated installations, including installations where localization of a disturbance is not required.

According to one aspect of the present invention a vibration detection and classification system includes a waveguide in operative contact with a boundary, at least one sensor for sensing vibrations operatively connected to the waveguide and providing a signal, and a control circuit operatively connected to the at least one sensor and adapted for filtering the signal into a plurality of frequency bands and detecting and classifying vibrations. The control circuit may be further adapted for detecting and classifying vibrations to determine if the boundary has been crossed by an intruder. The control circuit may include a transceiver for sending signals to a central computer for processing, such as via a radio modem.

According to another aspect of the present invention a vibration detection and classification system for a fence includes at least one sensor for receiving a vibration signal, an analog circuit portion operatively connected to the at least one sensor and filter the vibration signal into a plurality of bands, and a microcontroller operatively connected to the analog circuit portion. Each of the at least one sensor may include a spring wire operatively connected to the fence, a tension wire, and a clip operatively connected to the spring wire and the tension wire.

DETAILED DESCRIPTION OF THE PREFERRED EMBODIMENT

The present invention is now described in the context various preferred embodiments. The present invention, however, is not to be merely limited to what is described herein, but to what is claimed. The present invention is directed towards a system and method of using a waveguide sensor system for applications that include, but are not limited to detecting, localizing, and/or classifying a disruption along a boundary. A particular application, described throughout, but to which the invention is not limited, is the use of the present invention in a security fence for detection, classification and/or localization of intrusions. The present invention, however, contemplates that the system and methods of the present invention can be used to for monitoring purposes. Also, the present invention contemplates that once an intrusion is detected, classified, and located, appropriate security measures may be implemented.

Figure 1:
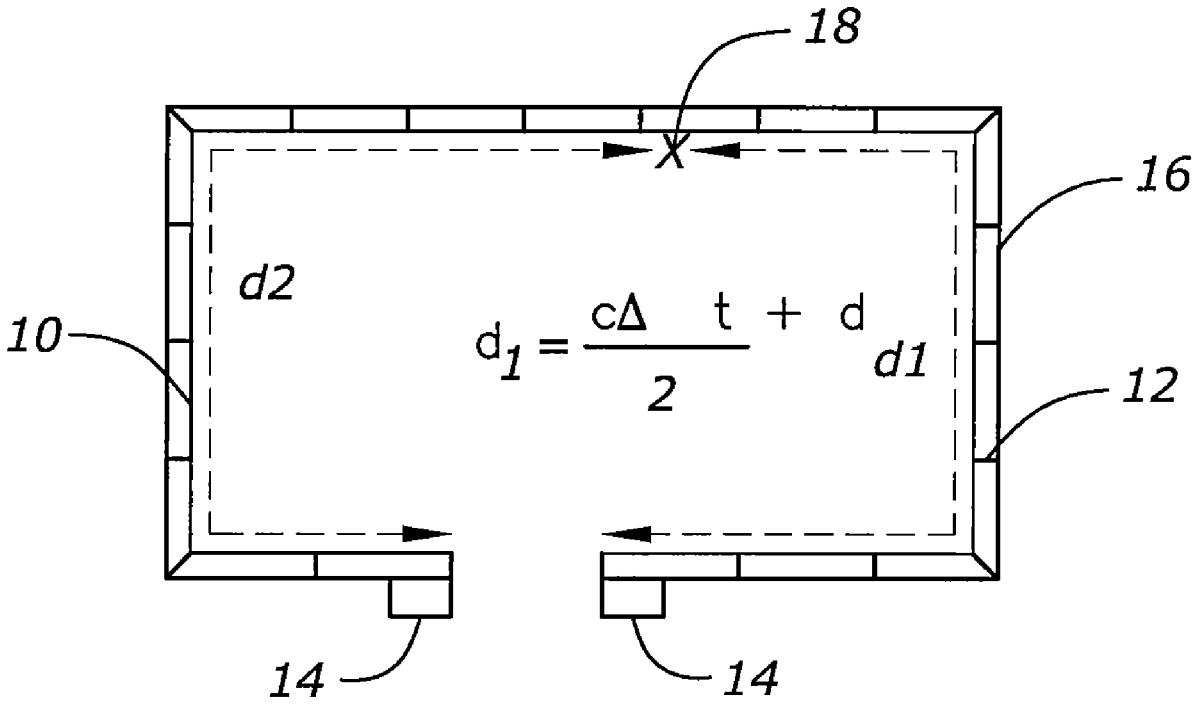
FIG. 1 illustrates a plan view of a fenced area equipped with vibration sensors.

U.S. Pat. No. 6,731,210 to Swanson et al describes how a waveguide is stretched around the perimeter of a new or existing fence. FIG. 1 illustrates such a waveguide 10 being secured to the fence 16 by a plurality of vibration couplers. The waveguide is installed such that it is kept taut between the vibration couplers 12. When a disturbance 18 occurs along the fence, the vibrational wave created by the disturbance 18 travels in both directions along the waveguide 10. These vibrational waves are intercepted by a plurality of transceivers 14. The transceivers 14 can include a control circuit that can include a processor adapted for time delay estimation. By comparing the difference in time between the interception of the vibrational waves by the transceivers, the location of the disturbance is determined through time delay estimation. Thus, in this manner, detection and localization of a disruption are provided.

Figure 2A:
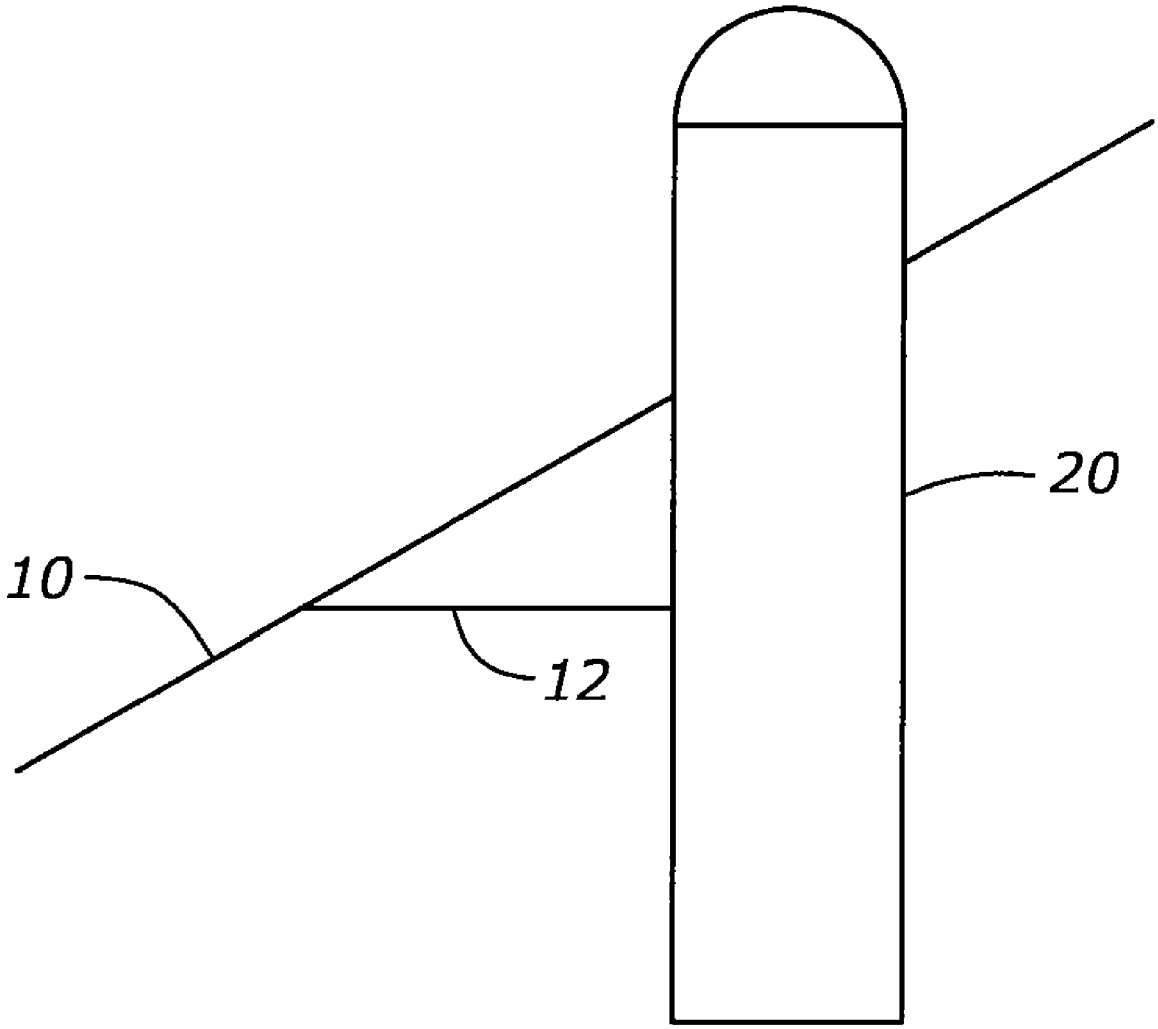
FIG. 2A illustrates a fence post connected to a vibration coupler.

In FIG. 2A, the waveguide 10 is secured to a plurality of fence posts 20 by a plurality of vibration couplers 12. The waveguide 10 may be comprised of any metallic or nonmetallic wire or cord-like material of the requisite strength and tension. One can choose practical tensions and wire thicknesses appropriate for the particular sensor fence installation. For safety and maintenance reasons, it is preferred to keep wire tensions between 50 to 200 pounds, however, the present invention is not to be limited to any particular wire tension. Tension is best maintained using a simple system of weights and pulleys. Alternatively, the waveguide 10 may be comprised of a hollow pipe filled with air, a known gas, or a liquid. Such a waveguide is particularly useful when the waveguide is located underground. The vibration coupler 12 is preferably formed of a strong and hard material. In the preferred embodiment, the vibration coupler 12 comprises a stiff wire.

Figure 2B:
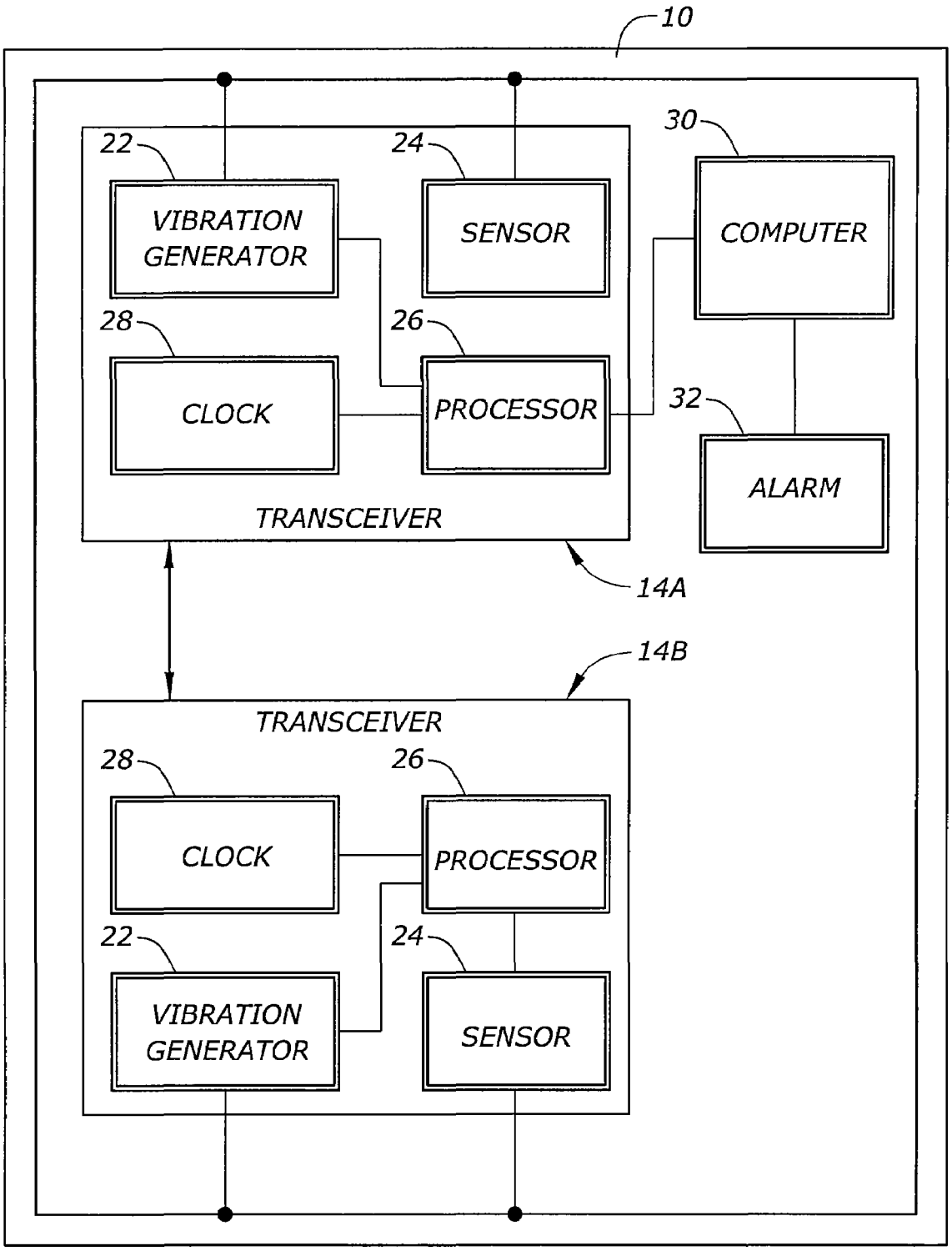
FIG. 2B illustrates a block diagram of a sensor node according to one embodiment of the present invention.

In FIG. 2B, a waveguide 10 such as tensioned wire is shown. The wave guide-10 is operatively connected to transceivers 14A and 14B. Each transceiver 14 includes a vibration generator or transmitter 22 and a sensor 24 operatively connected to the waveguide 10. The vibration generator 22 can be used for initialization or synchronization purposes. For example, each transceiver 14 also includes a processor 26 that is operatively connected to a clock 28. The clock 28 preferably relies upon the same external time base as any matching transceivers to improve the accuracy of time estimations. For example, each of the clocks 28 can rely upon a time from a GPS signal for synchronization purposes. A computer 30 is optionally connected to one or more of the transceivers 14 to provide for additional processing if desirable and/or additional monitoring or control functions. For example, the computer 30 can also be operatively connected to an alarm 32. The alarm 32 can be of any number of kinds. The alarm can be used to alert intruders that their presence has been detected, or to alert a security force. The alarm can activate lights, or cameras, deploy weapons, or perform other functions as may be appropriate in a particular application or implementation.

Following time synchronization, the signal is passed through an adaptive filter of a control circuit. Wave speed measurement, fence condition monitoring, and intrusion detection, localization, and classification all can be done simultaneously using well-known adaptive noise cancellation techniques. Since the transmitted waveform for wave speed measurement is known by both transceivers, it can be used to model the transfer function between the transmitting and receiving transceivers 14. This transfer function represents the vibration frequency response of the fence 16 and will change when an intruder climbs on or in any way stresses or contacts the fence 16 mechanically. Therefore, an abrupt change in the transfer function indicates an intrusion, damage, or a maintenance problem with the fence 16. Slow changes in the fence response likely indicate environmental changes or normal wear of the fence 16. Using an adaptive filter to model the fence frequency response, the error signal output represents the residual fence vibrations with the known vibration transmission removed. Thus, the error signal of the adaptive filter can be used to detect, localize, and classify intrusion disturbances.

The filtered signal is then analyzed and classified or otherwise further processed. Classification of disturbances is done using well-known statistical, neural network, and/or fuzzy logic techniques to identify and reduce false alarms due to environmental background noise. If the control circuit classifies the signal as a disturbance, the control circuit can alert or activate an external security system.

Because of the vibration generator or transmitter 22, pseudo-random sequences of vibrations can be transmitted along the waveguide 16 from one transceiver 14 to the other. This is useful as it allows for precise re-generation of a transmitted waveguide vibrations for modeling of the fence response and wave speed where the receivers are synchronized to a common clock source. This modeling is useful in deriving acoustic/vibrational signature classifications of intrusion activity and normal environmental activity in the fence. The transceiver is also useful for other applications as well. For example, transmitted waves can be used to measure frequency response of the fence, as a means of measuring wave speed in the waveguide, assessing fence condition, and to detect "quiet" intruders who come in contact with the fence.

However, it is not obvious how the vibration transmission in the wire is dominated by the longitudinal wave speed (about 5 km/s for steel) making time-of-arrival based localization difficult for small waveguide segments and for continued vibration disturbances. Extensive acoustical analysis of waveguide propagation has shown that a significant and repeatable attenuation exists in the waveguide and this attenuation is greater at higher frequencies then at lower frequencies. Background noise analysis has shown that the noise levels below a few hundred Hz increase significantly in wind, making a constant false alarm rate detector less sensitive. By using several bandpass filters and RMS envelope processing, we can process the fence vibration response over many kHz of bandwidth through the waveguide on the envelope signals, which are only a few Hz bandwidth. Thus, if sensitivity is diminished in one band, the other bands can compensate. Combining the detections in the various bands provides a means to better localize and objectively define a variable localization error, which the end user can take into consideration when responding to the intrusion detection. This process also simplifies the sensor detectors for each segment, allowing a common electronic design to serve a small perimeter as well as a network of these sensor nodes feeding their detections to a central processor, or redundant processors, for monitoring large perimeters with many segments.

Figure 3:
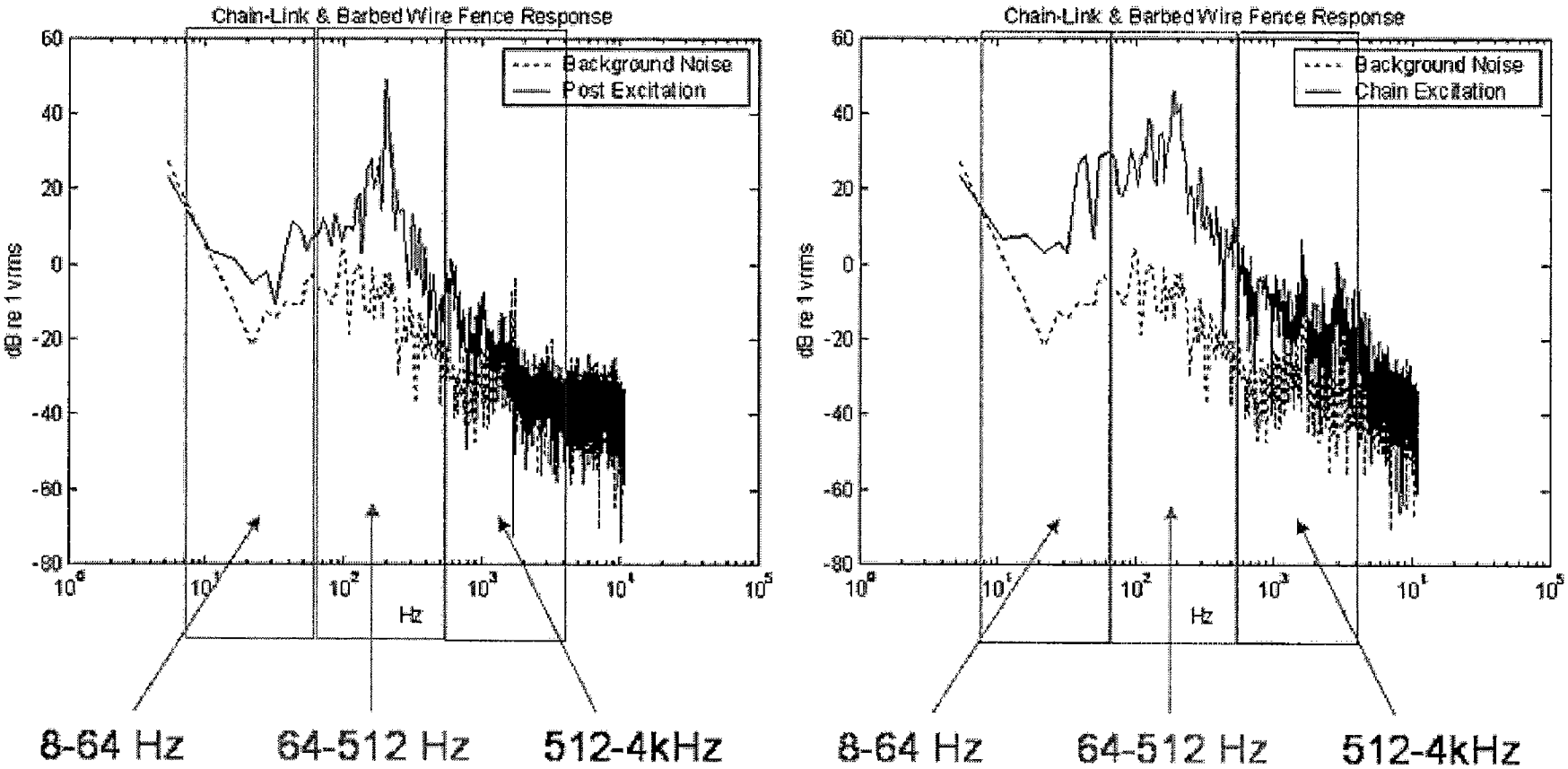
FIG. 3 illustrates vibration spectra of chain shaking and top barbed wire excitation showing very different signal levels in a low, medium, and high frequency band.

To assist in understanding the complexities involved, we begin our discussion of the observed waveguide signals by describing the background noise and intrusion disturbances. Some of the quietest background noises are observed during snowfall in light winds. This is because the snow acoustically insulates the ground from many sources of outdoor noise and the lack of wind reduces seismic vibration as well as direct vibration of the fence. Trees even a few hundred meters from the fence can produce low frequency seismic vibrations from wind that will couple through the ground into the fence foundation, fence posts, and finally into the waveguide and sensors. Any signs mounted on the fence fabric or staves woven into the fence will enhance this vibration. The noise spectrum of this wind and environmental noise has a shape inversely proportional to frequency (1/f) up to 100-200 Hz, flattening at higher frequencies when observed using an accelerometer. Using a geophone which senses velocity, or a Hall-effect sensor which senses displacement further amplifies this noise, which is why we prefer accelerometers as the sensor. Accelerometers naturally enhance higher frequencies. The difference in low and high frequency environmental noise is why we prefer to use multiple frequency bands and data fusion to enhance detection and reduce false alarms. FIG. 3 shows some typical spectra and preferred bands.

Other forms of noise are spectrally white such as the impacts of rain drops and the natural creaks and pops of the fence caused by thermal expansion, contraction and small ground movements affecting the tilt of the fence vertical support posts. These sounds are similar to the intrusion sound of cutting the chain link fabric, but are less frequent and more random. To reduce the rain noise, we use a small wire 12 of very high hardness in place of a metal band of the prior art to support the tensioned waveguide wire 10. Thus, we have reduced the cross section exposed to rain and wind. While a ½" band supporting the waveguide wire 30 to 100 cm inside the fence may not seem like a significant areas exposed to rain, 300 of them spaced over a 1 km segment yields an area of up to 37 square feet (3.8 $m^2$) which will collect a significant amount of rain noise from direct drop impacts. Furthermore, changing the shape from a band to a stiff wire reduces the cross-section to a size smaller than many of the rain drops, thereby reducing the excitation force of those raindrops that do impact the support clips made from wire. Wind noise is also significantly reduced because the wire shape generates far less drag and turbulence than a band.

Figure 4:
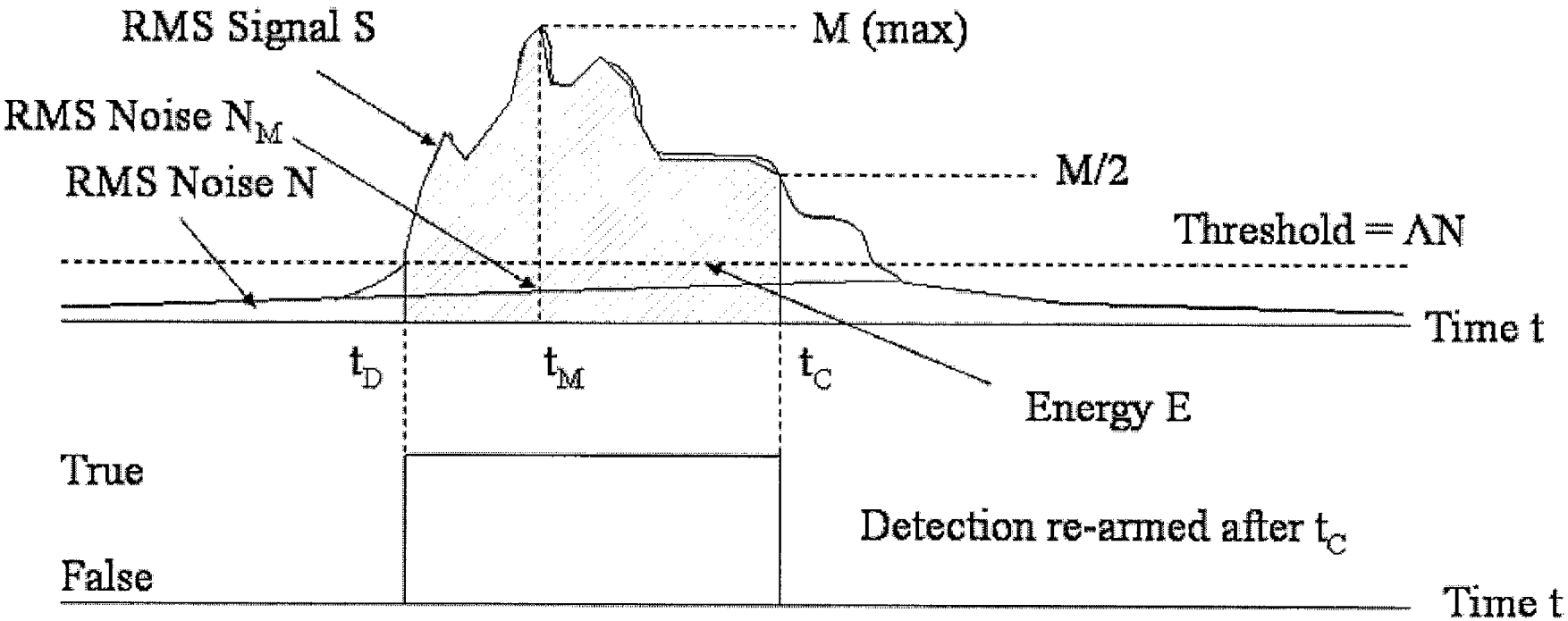
FIG. 4 illustrates generic detection features of time of detect $t_D$, time of maximum, $t_M$, time of closure, $t_C$, signal S, noise N, and threshold ratio ΛN are used to characterize all detections by the sensor node.

The intrusion signal is generally a type of transient because the intruder will not want to be seen anywhere near the fence area. Climbing over the fence will produce several seconds to nearly a minute of random vibrations and rattles concentrated at the intrusion point. The same is true for crawling under the fence if possible. Crawling under generally involves cutting the fence fabric which means a series of impact vibrations will occur originating from the same location in the waveguide wire segment. These characteristics are used to generate generic classification features for each intrusion detection such as the amplitude, time duration, energy, and event rate which are produced separately in each frequency band by the sensor processor node and sent to a central processor via wired or wireless Ethernet for localization and classification processing as seen in FIG. 4.

While the intrusion signal propagates through the tension wire waveguide and arrives at the segment end sensors at different times, we observed that this wave propagation is very complicated. There are actually three types of wave propagation in the wire. First there is the longitudinal wave with a speed of about 5 km/s for a steel wire. Then there is a bending wave speed whose velocity is proportional to the square root of frequency. Finally, there is a "string mode", or transverse wave, which is equal to the square root of tension over mass per length. The range of wave speeds in a tensioned wire goes from km/s down to m/s. To make the propagation even more complicated, wave reflections happen at each attachment point on the wire and especially at the end brackets and corners, if the wire traverses the corner. Localizing the intrusion position using time of arrival was found to work only for the initial disturbance wave, not for continued disturbances by an intruder.

Figure 5:
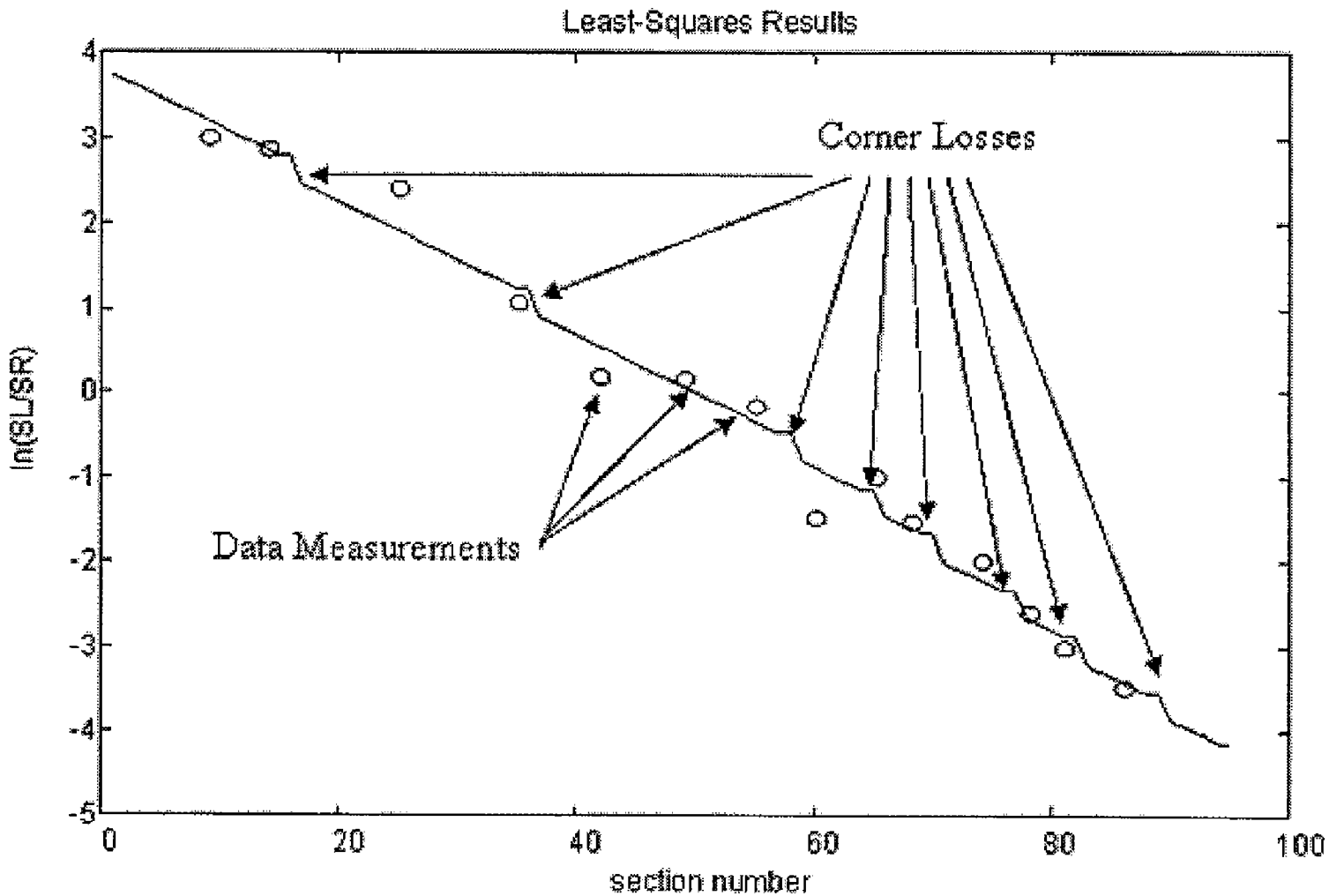
FIG. 5 illustrates the natural logarithm of the ratio of the signal envelope measured simultaneously at either end of the waveguide wire segment correlates extremely well to the location of the disturbance along the wire.

As the intrusion wave propagates along the tensioned wire, signal losses occur which are proportional to propagation distance. This wave attenuation is from internal damping in the wire, damping by the air, and losses from reflections and coupling into the fence at the spring clip attachment points, and is independent of the actual tension of the wire. These losses are more profound at higher frequencies than lower frequencies over the same propagation distance. If the clip attachments are at nearly regular intervals, we can calibrate the localization algorithm by recording the ratio of received disturbance amplitudes or energies (amplitude times duration) for the two sensors at either end of the segment for several known disturbance locations. This calibration provides a loss per meter measure for each frequency band which can be seen as a sloping line on a plot with the logarithm of the sensor signal ration verse distance along the segment. As such, given the logarithm of the ratio of the sensor signals, the location of the disturbance can be estimated in a given frequency band. FIG. 5 shows some data and an attenuation model fitted by least-squares. Note that the natural logarithm of the ratio of the signal envelope measured simultaneously at either end of the waveguide wire segments correlates extremely well to the location of the disturbance along the wire.

Figure 6:
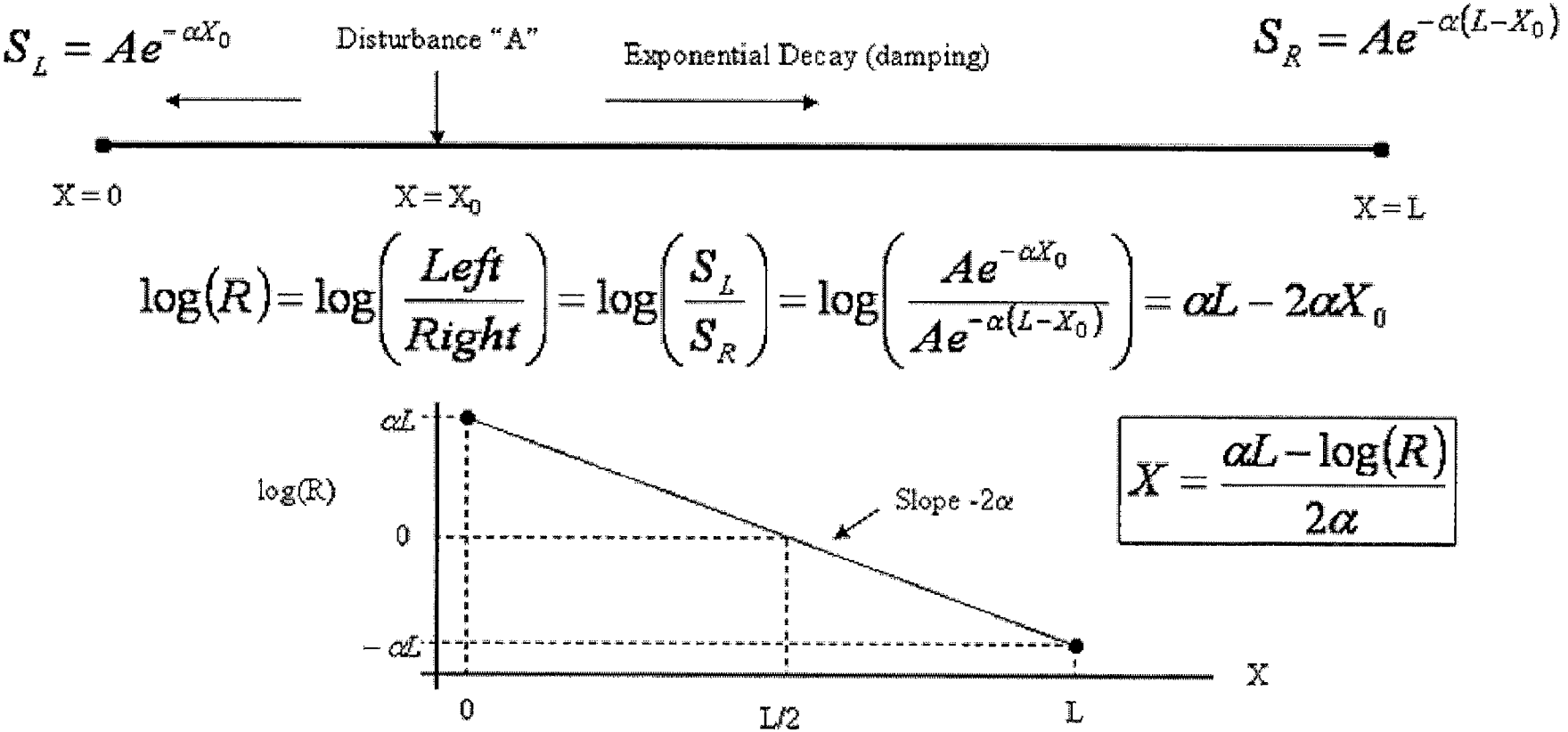
FIG. 6 illustrates the ratio of the signal levels at either end of the waveguide segment can be used to localize the intrusion disturbance when the segment is uniform and the attenuation loss is known.

An envelope signal level ratio can therefore be used to localize a disturbance along the wire waveguide, due to the losses of vibration as they propagate along the waveguide. Since the fence and the waveguide wire with its support clips are uniform along the segment monitored on either end by the node sensors, calibration is a matter of determining the attenuation loss per distance (meter, foot, or even fence section between regularly-space posts). FIG. 6 explains the algorithm in detail, illustrating how the ratio of the signal levels at either end of the waveguide segment can be used to localize the intrusion disturbance when the segment is uniform and the attenuation loss is known. Calibration is straightforwardly done by exciting the fence in two separate trials at different locations, preferably near the endpoints and of sufficient energy to trigger a detection at both ends of the segment. Since the length of the segment L is known, one can plot two or more points where the log-ratio of vibration envelope levels is the ordinate (y-axis), and the position is the abscissa (x-axis). The slope of the least-squared error line fit is $-2\alpha$, where $\alpha$ is the loss per distance. This log-ratio is limited to a range defined by the length of the segment time the loss $\alpha L$, which should be exceeded by the signal dynamic range of the sensor nodes. This loss per length is known to be greater at higher frequency bands and can be approximated within a particular frequency band. Also, while the envelop log-ratio are to be simultaneous, this requirement is only approximate as the signal RMS averaging is assumed to be longer than the fastest propagation time for the segment (200 ms for 1 km). For longer segments and shorter signal RMS averaging, the time-of-arrival must be included to align the detection signal levels appropriately.

Figure 7:
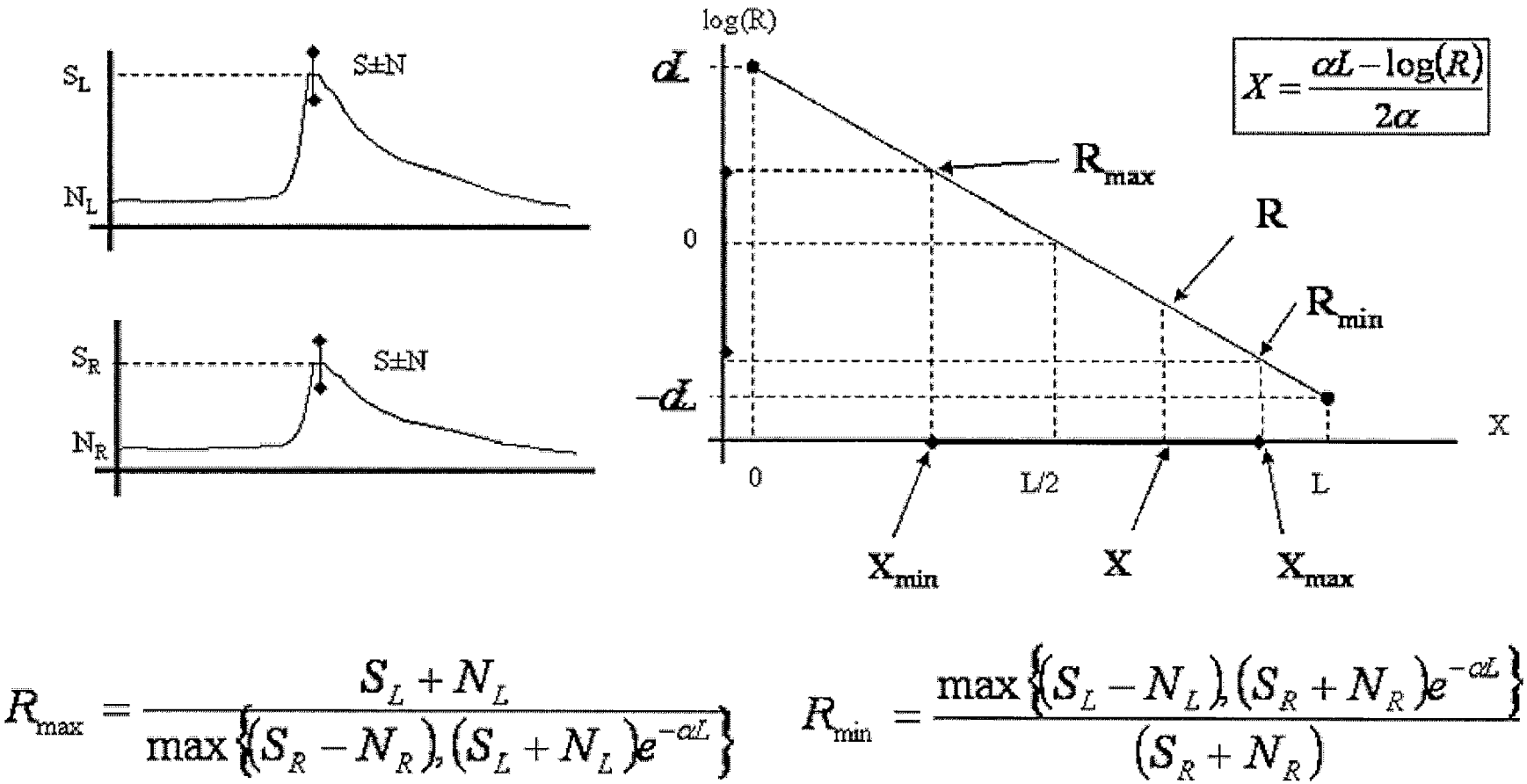
FIG. 7 illustrates the maximum and minimum log-ratios, based on each channel's signal and noise levels are used to estimate a position error for the intrusion detection in each frequency band.

Localization error is estimated based on the signal to noise ratio for each sensor signal. The sensor "signal" is a short time RMS average and the "noise" is a longer time RMS average designed to float with the changing background noise but not be affected much by intrusion signals. Using the Cramer-Rao lower bound (CRLB) for the variance of a finite mean estimate, we can use the variability of the signal RMS levels for each sensor to define the maximum and minimum ratios, and thus a corresponding position error bracket for the localized intrusion. When the signal-to-noise ratio (SNR) is high for both sensor detections, the CRLB variability is small yielding an accurate localization. The localization error grows as the SNR decreases. For cases where the SNR is high at one sensor and low at the other, the error range for the localization grows toward the low SNR sensor. FIG. 7 depicts this algorithm which allows the error to be objectively asymmetric based on the SNR at each sensor. For both sensors having a high SNR, the maximum and minimum ratios naturally converge to the mean signal log-ratio, giving a correspondingly small position error. When the SNR is low at one sensor, the maximum or minimum ratio on the corresponding side will provide a larger position error then on the high SNR side. This is a very useful algorithm for automatically positioning and zooming the field of view on cameras that automatically respond to the Sensor Fence intrusion.

The central processor for one or more segments receives detection "packets" from each sensor node with detection features and then polls the sensor node on the other end of the segment for signal and noise levels. If both sensor nodes on the segment make a near simultaneous detection (signal levels surpassing noise levels by some predefined detection threshold ratio), then central processor actually calculates slightly redundant localizations, but that is seen as a desirable feature in terms of simplicity in processing architecture and only a minor redundancy computational burden. Each node has a number of frequency bands (say 3) for which detections can be made and reported to the central processor. So, for a given segment and intrusion event, the central processor could get up to 6 detection packets to resolve if there are 3 frequency bands. Since each of the detection packets contains only a few dozen bytes, the communication and processing times are easily handled with inexpensive existing technology. The sensor node communication to the central processor can be either intrusion event-driven, or a polled response to a regular request for data by the central processor. The polled response is a simpler protocol but requires more electrical power for the frequent communications.

Figure 8:
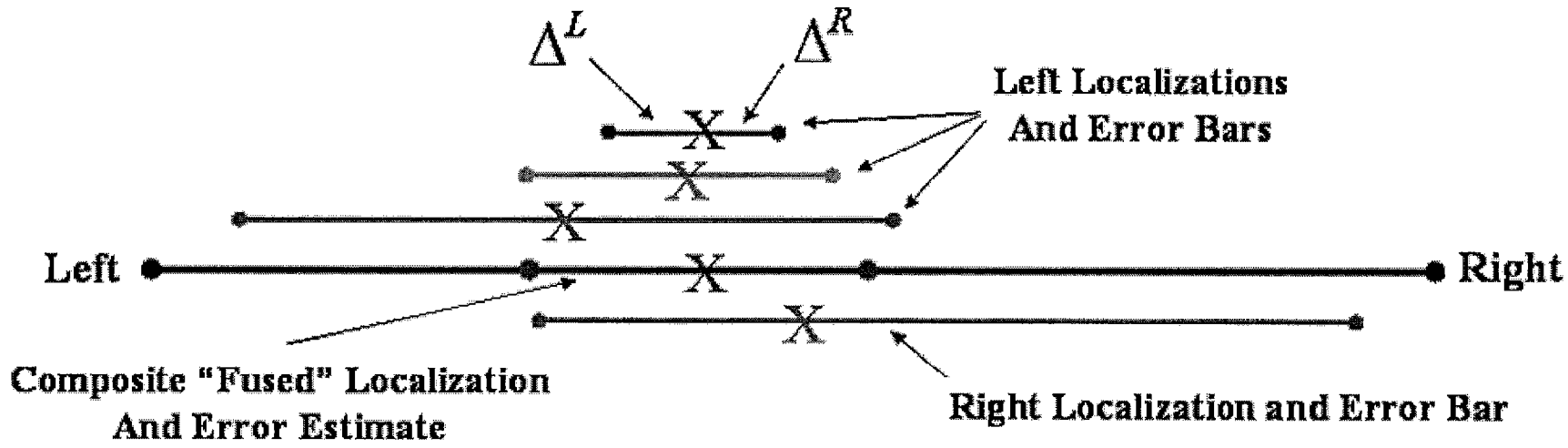
FIG. 8 illustrates redundant detections from each sensor node in a common segment and frequency band, and detections in other frequency bands, are fused using inverse error weighting for position and error averaging for the right and left error ranges.

FIG. 8 shows how the position estimates and error within a given time window are fused into a signal position estimate and error.

Figure 9:
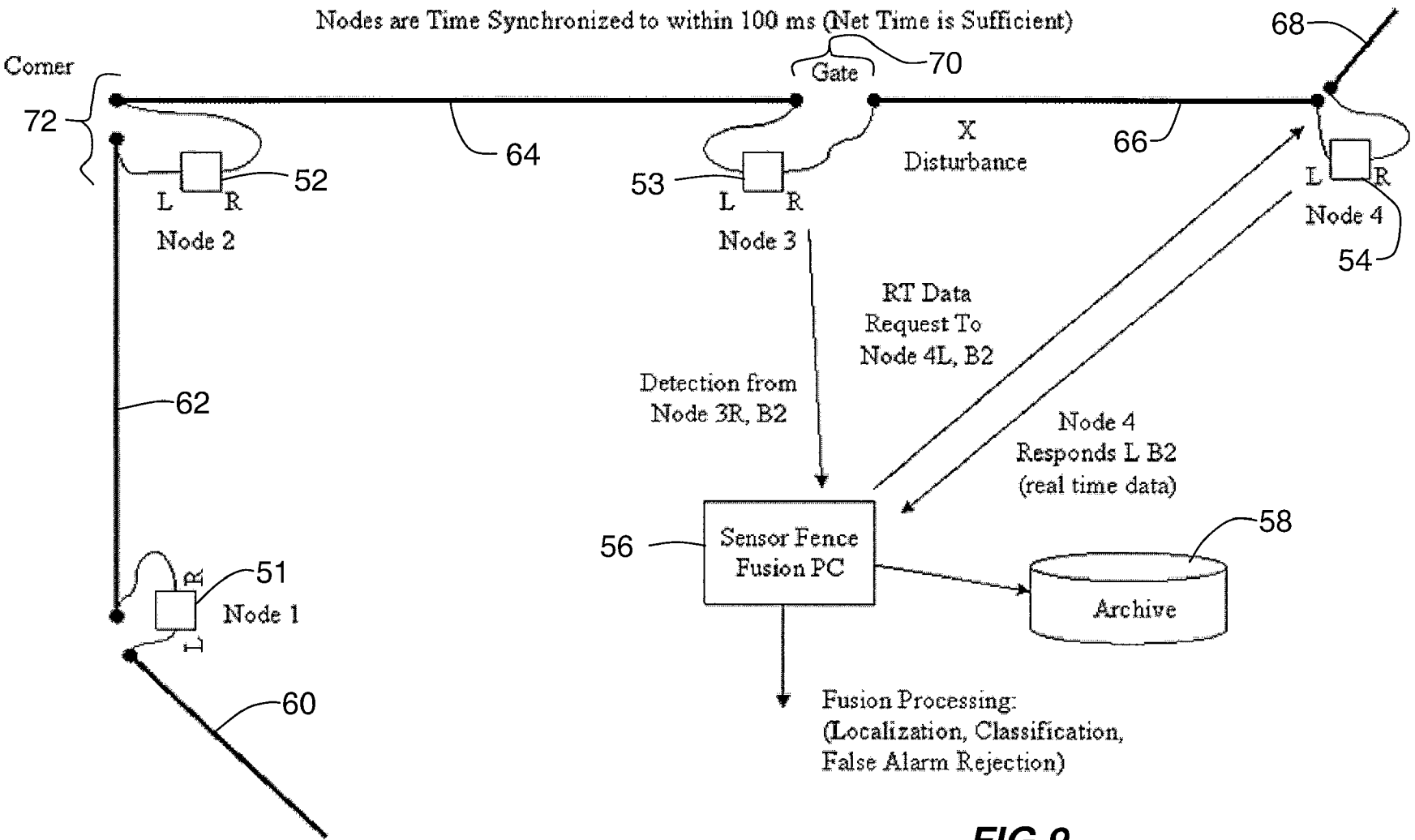
FIG. 9 illustrates a central processor receives detection packets from the segment node, polls the node ant the opposite end of the segment to get the log ratio and SNR, rejects nuisance alarms, and uses data fusion to compile redundant detections.

FIG. 9 shows the localization processing architecture for networking the detection nodes of one embodiment of the present invention. As shown in FIG. 9, a system 50 includes a plurality of segments, including segments 60, 62, 64, 66, and 68. Between segments a node is placed. A first node 51, second node 52, third node 53, and a fourth node 54 is provided. Each node 51, 52, 53, 54 has both a left channel connected to one segment and a right channel connected to another segment. Note that a node 52 can be placed at a corner 72, or a node 53 can be placed across a gate 70. Information from the nodes 51, 52, 53, 54 is communicated to an intelligent control such as a PC 56. The PC 56 is also operatively connected to an archive 58 for storing information. The PC receives detection packets from each segment node 51, 52, 53, 54, polls the node at the opposite end of the segment to get the log ratio and SNR, rejects nuisance alarms, and uses data fusion to compile redundant detections. This architecture is completely scaleable to hundreds of segments and the PC 56 can be anywhere in the world and part of a much larger security automation system. The sensor nodes are identical except for software parameters identifying and configuring them. The same sensor nodes can be used for a single segment looped around a modest sized closed perimeter (say either side of a gate), or a single sensor with one node processor could be used for very small perimeters where no localization is needed.

The redundancy of detection packets are used for corroborative data fusion by the central processor. Detections reported within a limited time window are associated, localized, and classified into event types of "cut", "hit", or "climb" for intrusions, or "nuisance alarm (NA)" for all others. Events such as cutting of the fence fabric are distinguished from rain drops, creaks, and pops, from the randomness of the later and the regular-ness of the former. In other words, cutting through the fence will require several (perhaps 5 to 15) cuts through the metal chain link in a period of a minute or less. This has been previously recognized in U.S. Pat. No. 4,635,239, herein incorporated by reference in its entirety. Here, the detection nodes 51, 52, 53, 54, report each cut to the central PC 56. The central PC 56 would further associate cut intrusions over a wider time window to assess the cut rate. If one is getting, for instance, 3 or more cuts of the same location and classification features within a given number of seconds, all of the cuts are grouped into one "cut intrusion" event. This general approach should allow rejection of most of the false and nuisance alarms observed. By characterizing duration, approximate location count, and amplitude of the detection event, false alarms from rain, wind gusts, and fence expansion/contractions are prevented from falsely triggering an intrusion. The RMS averaging times of the signal and noise already provide detection from false alarms by steady winds and rain.

Since the communication and computation requirements on the central PC 56 are low for each segment 60, 62, 64, 66, the central PC 56 can monitor many segments, perhaps into the hundreds, but likely on the order of 4 to 12 segments. Because we prefer using TCP-IP and Ethernet, multiple central PC's can monitor the same segments and the central PC 56 can be thousands of miles away. This offers many flexibilities and redundancies for an installation design, all using the same simple hardware. Of course, other types of networks and network protocols may be used. Since segments are adjacent, the preferred embodiment of the sensing node is to have 2 channels, one for each segment, if needed. Furthermore, the sensor node has a simple relay closure for any detection. This allows a single node to automatically turn on lights or sirens or other devices without a central PC if used for small perimeters such as private swimming pools.

Small Perimeters

Figure 10:
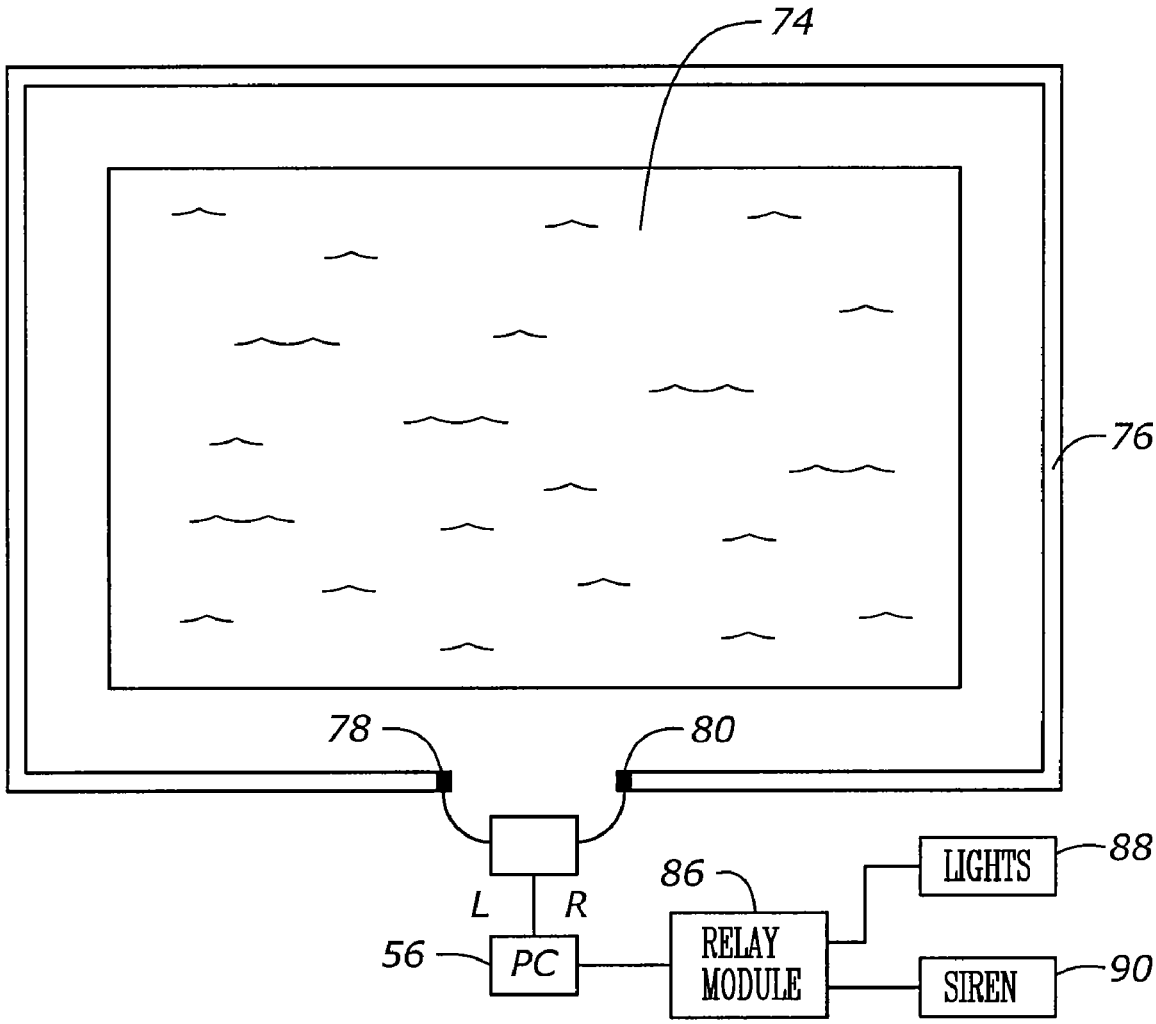
FIG. 10 illustrates one embodiment of a sensor system for use with a small area, in this case a pool. Note that only a single sensor node is used.

One embodiment of the present invention is suitable for use in small perimeters, including perimeters under 300 m. One example of such a small perimeter is the perimeter of a swimming pool. FIG. 10 illustrates a swimming pool 74 having surrounded by a fence 76 defining a perimeter. In the illustrated system, a single sensing node 51 is used to provide a single channel of information. A relay module 86 is shown which provides for activating one or more circuits. The circuits may be for lights 88, warning sirens 90, or other circuits associated with a security or alarm system. This embodiment provides a very low cost system. However, this system does not provide for localization or classification capability. Thus, such a system is not practical for situations where false alarms are of concern.

The embodiment of FIG. 10 is a non-localizing embodiment. In addition to swimming pools this embodiment may be used for a small cell phone tower, or small utility station. It should be appreciated that one of the benefits of the non-localizing embodiment of the user is a time advance warning prior to the intruder breaking into the facility or entering the water of the swimming pool.

Intermediate Perimeter

Figure 11:
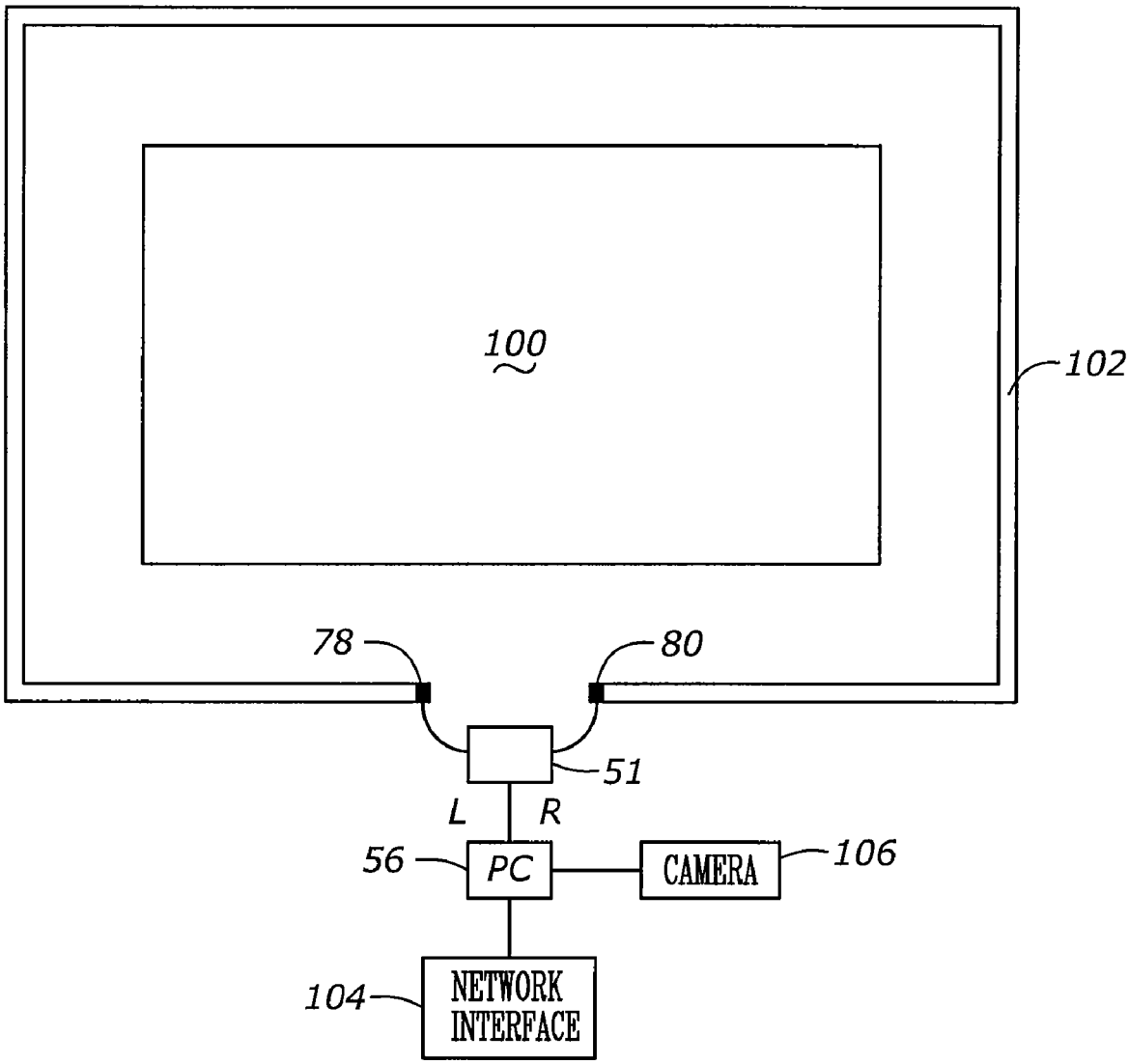
FIG. 11 illustrates one embodiment of a sensor system for use with a medium area, such as a building. Note that only a single sensor node needs to be used.

A second embodiment of the present invention is suitable for use with a closed perimeter of larger scale, such as, but not limited to 300 to 1000 meter. Such a perimeter may be associated with a building. FIG. 11 illustrates one such embodiment of the present invention. Here, a single sensing node 51 is used which provides two channels. A central PC 56 or other electronic device remotely localizes and classifies for low false alarms. An interface, such as a network interface 104, such as an Ethernet interface connects other assets. One example of another asset is a camera 106. Thus, in this system, evidence is gathered which can be used for subsequent investigations.

Large Perimeters, Lines

Figure 12:
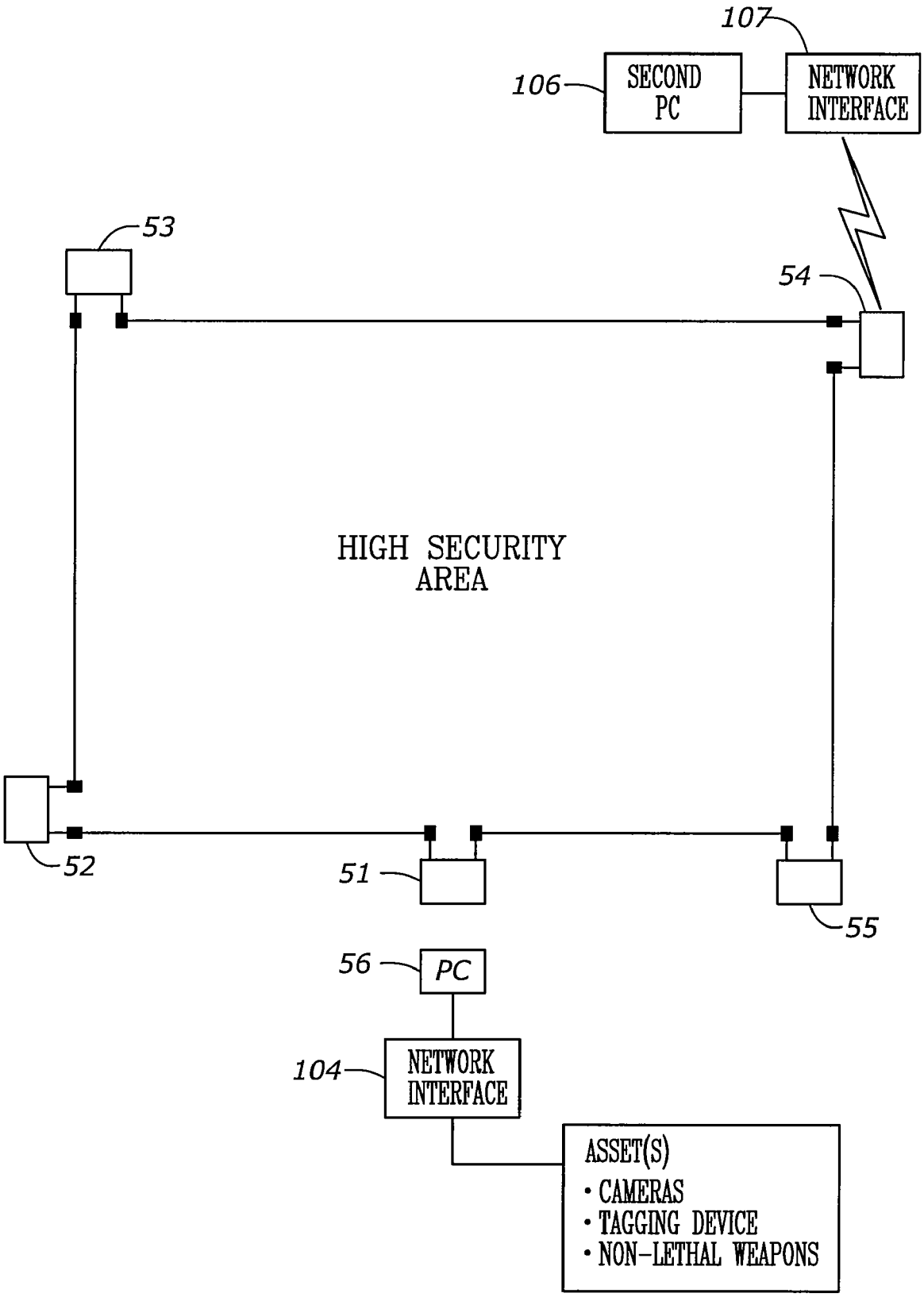
FIG. 12 illustrates one embodiment of a sensor system of the present invention for use in a high security area. Note that multiple sensor nodes are used which may communication with multiple PCs either local or remote.

A third embodiment of the present invention can be used for large perimeters or fence lines. Examples of such applications include, without limitation, building complexes, ports, refineries, national borders, transportation corridors, and pipelines. FIG. 12 illustrates one such embodiment of the present invention. In this embodiment, the perimeter is segmented. One convenient size for the segments is a nominal 1 km per segment. Of course, other segment sizes may be used. A central remote 56 and redundant PC's or other electronic devices localize, classify, and control other sensing assets. Examples of sensing assets may include cameras, tagging devices, non-lethal weapons, or other types of devices. This embodiment provides a low cost outer layer for advanced intrusion warning such as may be appropriate in high security areas.

As shown in FIG. 12, a second PC 106 is shown which may be remotely located and is operatively connected to a network interface 107. The second pc 106 communicates with sensing nodes 51, 52, 53, 54, 55. As previously expressed, the sensing nodes 51, 52, 53, 54, 55 may be wireless communication with PC 56. A network interface 104 may communicate that information to a second pc 106 through a network interface 107. Alternatively, the network interface 104 may be in direct communications with the sensing nodes 51, 52, 53, 54, 55 to communicate this information over a network.

Thus, it should be apparent that due to this configuration, a fence or boundary, or any number of fences or boundaries may be monitored remotely from across the country or around the world.

Calibration

Another aspect of the present invention is to provide a general calibration technique for non-experts to use in the field for setup of a localization algorithm based on received vibrations at either end of a tensioned wire. This wire may be attached to a fence, as previously described. The user creates a simple file of positions of the wire corner supports and endpoints, specifies the distance between wire attachments, and then records a set of known disturbances at various points along the wire. This data is processed to automatically produce a file containing a detailed listing of all the wire attachment positions and the relative vibration levels associated with each. It also provides a metric of the vibration losses per section and per corner. These physical parameters can be used for design models to specify tensioned wire intrusion installations.

The process starts with user describing the basic layout of the tensioned wire for a 2-channel (stereo) detection system. This starts with the right sensor location near one endpoint and includes each corner mounting point until the left sensor near the other end point. In the calibration process, these "corners" will be treated with a different loss factor than the loss factor for each section of wire suspended by spring clips to the fence or other structure of interest. Table 1 shows the basic layout for our demonstration fence.

TABLE 1

| Basic Layout | |
|---|---|
| 10 | Pair Numbers |
| 10 | Section size |
| X-coordinate | Y-coordinate |
| 130 | 0 |
| 280 | 0 |
| 280 | 210 |

TABLE 1-continued

| Basic Layout | |
|---|---|
| 10 | Pair Numbers |
| 10 | Section size |
| X-coordinate | Y-coordinate |
| 50 | 210 |
| 50 | 140 |
| 0 | 140 |
| 0 | 70 |
| 50 | 70 |
| 50 | 0 |
| 110 | 0 |

Figure 13:
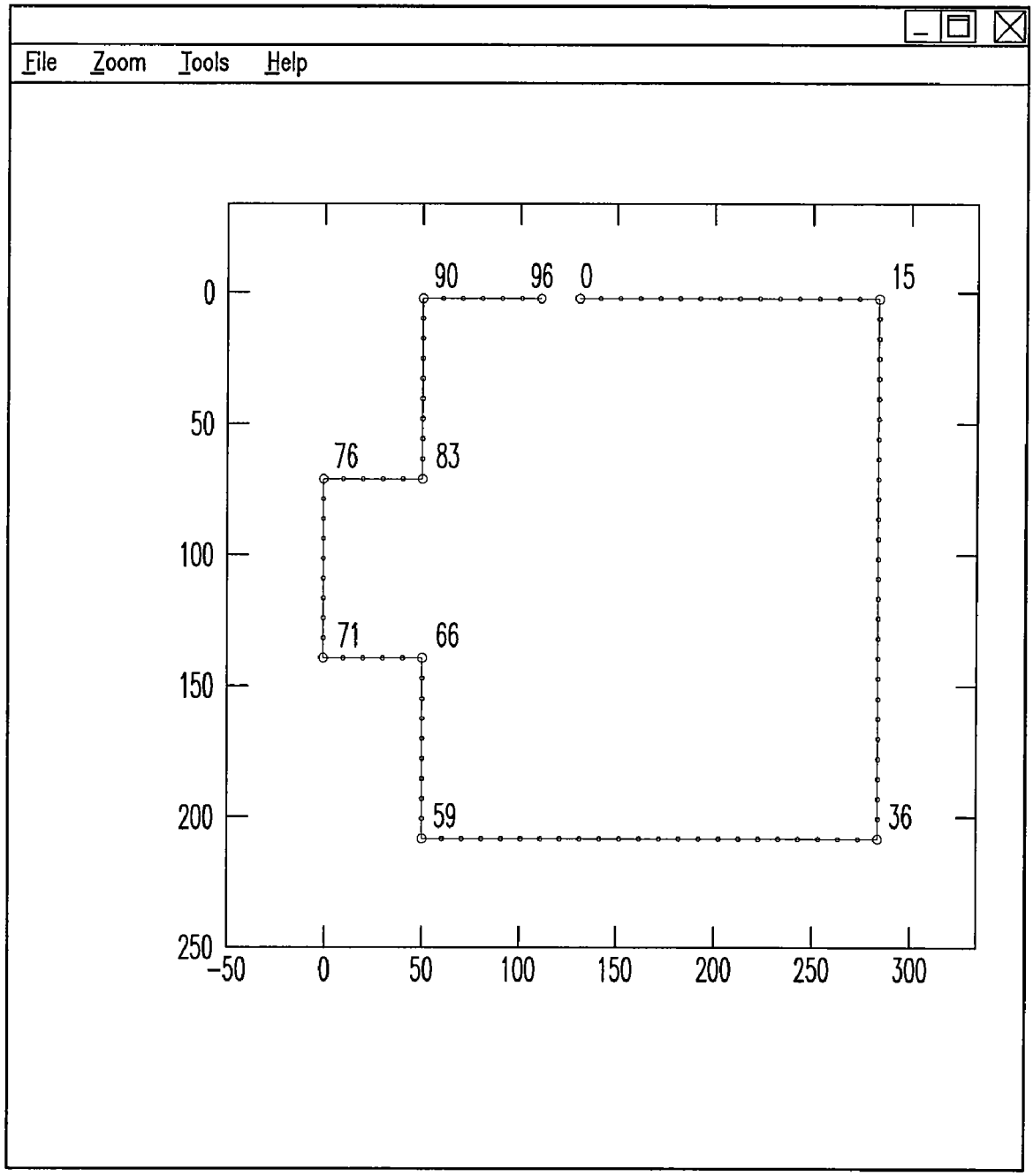
FIG. 13 illustrates a screen display of a software application used for configuring a perimeter according to one embodiment of the present invention.

The basic layout is read and a map of the fence is generated as seen in FIG. 13. Such a program may be written in any number of languages or any number of platforms.

The information in FIG. 13 can save the user a great deal of time and work for large fence installations. Each dot represents a wire attachment point and each open circle represents a corner or endpoint attachment. The endpoints are vibration-wise approximately rigid while the wire attachment points represent a small spring and loss mechanism. This loss of vibrations in the wire back into the fence or other structure, are designed to be small, but they are not insignificant. At the corners, the full tension of the wire is supported by a separate wire loop around the corner post. This is as light and strong as possible to minimize vibration reflections at the corners, although it is not possible to completely eliminate these losses. The corner losses are observed to be consistently greater than the wire attachment losses. It is useful to label several positions with the section number between each of the corners and the endpoints and corners. These section number positions will be used for calibration of the localization algorithm.

Calibration requires excitation of the wire at known locations and recording the ratio of the right RMS vibration signal divided by the left RMS vibration signal. This makes the calibration independent of the excitation level, so long as the excitation level has a positive signal to noise ratio (SNR) at both the right and left receivers simultaneously during the measurement. As a matter of convenience, we show in Table 2 the natural logarithm of the right over left RMS vibration ratio verses the excitation position.

TABLE 2

| Example Calibration Data | |
|---|---|
| Attachment | Ln(R/L) |
| 9 | 3.02 |
| 14 | 2.89 |
| 25 | 2.41 |
| 35 | 1.09 |
| 42 | 0.200 |
| 49 | 0.190 |
| 55 | −0.147 |
| 60 | −1.46 |
| 65 | −0.980 |
| 68 | −1.52 |
| 74 | −1.97 |
| 78 | −2.59 |
| 81 | −3.00 |
| 86 | −3.46 |

The excitation can be either a steady state vibration such as an off-balance motor attached to the wire, or an impulsive impact on the wire or supporting structure such as a modest collision or shaking of the fence. For impulsive excitations, the time dependency is accounted for automatically by employing the detection algorithm shown in FIG. 14.

Figure 14:
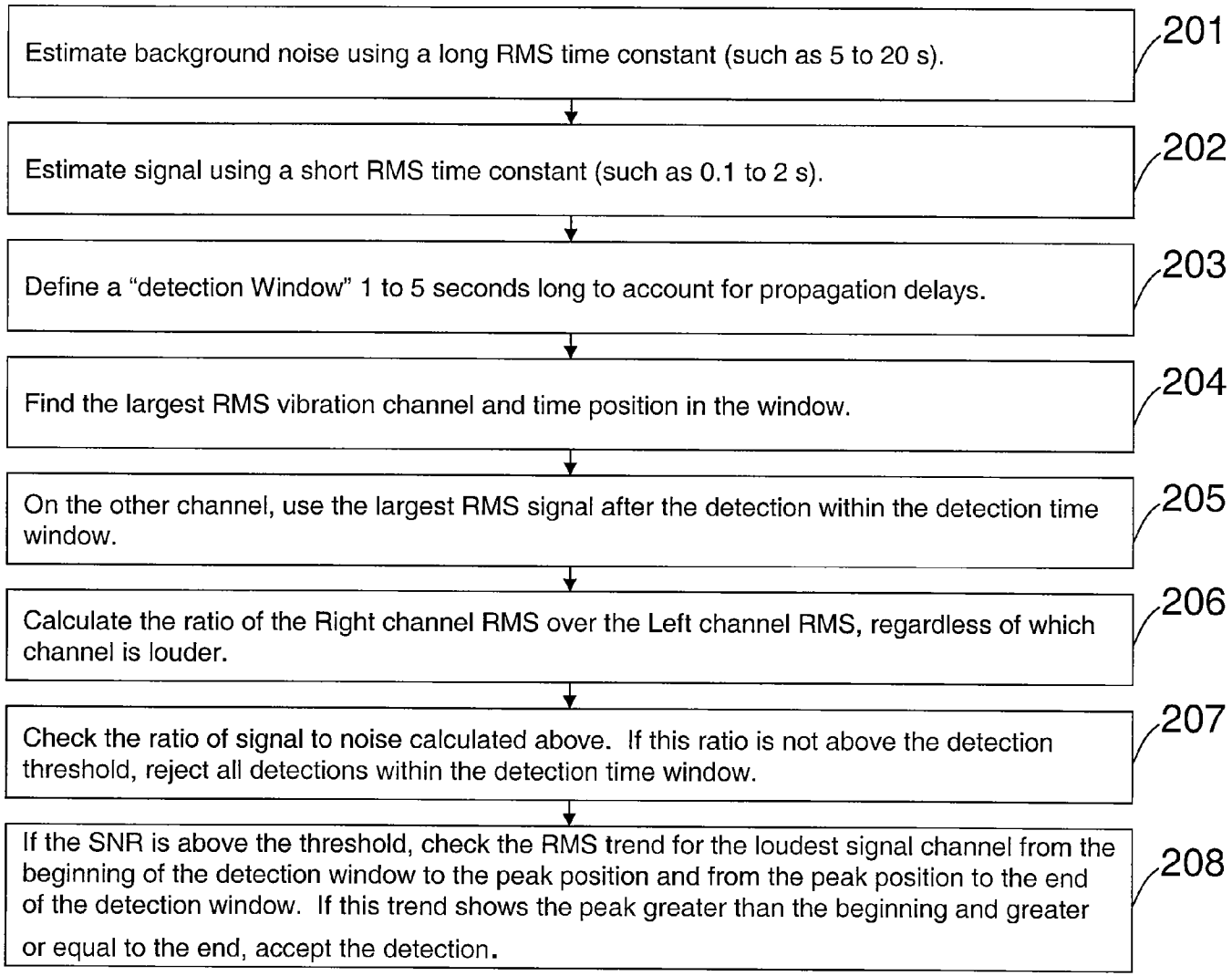
FIG. 14 is a flow chart illustrating a methodology according to one embodiment of the present invention.

As shown in FIG. 14, in step 201, background noise is estimated using a long RMS time constant of 5 to 20 seconds. Next in step 202, a signal is estimated using a short RMS time constant of 0.1 to 2 seconds. Note that long RMS time constant is relatively long with respect to the short RMS time constant. Although preferred ranges have been set forth, the present invention contemplates variations beyond the given ranges.

Next, in step 203, a "detection window" is defined which is preferably 1 to 5 seconds long to account for propagation delays. In step 204, the method finds the largest RMS vibration channel and time position in the window. In step 205, on the other channel, use the largest RMS signal after the detection within the detection time window. Then, in step 206, the method calculates the ratio of the Right channel RMS over the Left channel RMS, regardless of which channel is louder. In step 207, the method check the ratio of signal to noise calculated in steps 201 and 202. If this ratio is not above the detection threshold, reject all detections within the detection time window. Finally, in step 208, if the SNR is above the threshold, check the RMS trend for the loudest signal channel from the beginning of the detection window to the peak position and from the peak position to the end of the detection window. If this trend shows the peak greater than the beginning and greater or equal to the end, accept the detection.

Step 201 in the detection algorithm rejects "echoes" as the wire reverberates after an impulsive excitation. The "echoes" may give good localization for a short period, but as the reverberation SNR declines, the localization will grow in error. The above detection algorithm tends to reject these "echoes" while still capturing the main excitation of an intrusion. Adjustments to the algorithm allow for control of false alarms and detection sensitivity.

The physical basis for the calibration algorithm takes into account any loudness imbalance between the two sensor channels as well as differences in vibration loss in the wire sections and the corners in a non-obvious way. Consider the fence in FIG. 15.

Figure 15:
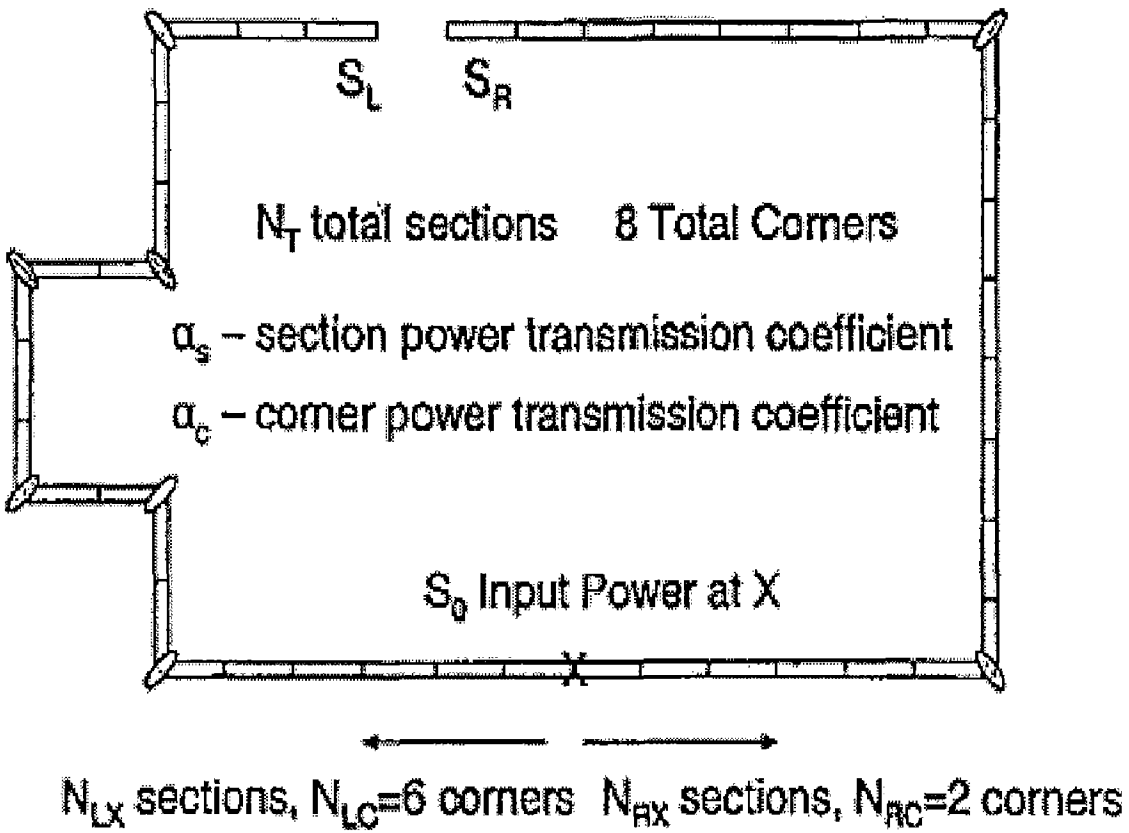
FIG. 15 illustrates one embodiment of a fence used to assist in explaining calibration methodology of the present invention.

The vibration power that reaches the right sensor in FIG. 15 is $$S_R = \frac{1}{2} S_0 \alpha_c^{N_{RC}} \alpha_s^{N_{RX}} \tag{1}$$

The power reaching the left sensor is $$S_L = \frac{1}{2} S_0 \alpha_C^{N_{LC}} \alpha_s^{N_{LX}} \tag{2}$$

If the section power transmission coefficient $\alpha_s$ is 0.96, 96% of the vibration power entering the section is transmitted and 4% is lost into the wire support clips. This is very efficient, but if the vibration travels through 100 sections of wire, the total loss is $1.00\text{-}0.96^{100}$ or over 98% (35 dB power attenuation).

If the corner power transmission coefficient $\alpha_c$ is 0.90, there is a 10% vibration power loss at each corner, plus the loss due to the wire support. The total loss in 8 corners is $1.00\text{-}(0.90\times0.96)^8$ or 69% (10.2 dB power attenuation). Even though the reflections and losses at the corners are greater, the effect on the total system vibration power loss is less because there are not as many of them.

One can trade localization for detection distance by using fewer wire supports, or increase localization accuracy over a smaller distance by using more wire supports per meter.

The present invention may take into account any sensitivity differences between the right and left channels and remove the excitation level dependence by dividing equation (1) by equation (2) and taking natural logarithms.

$$\log\left(\frac{S_R}{S_L}\right) = RL + (N_{RX} - N_{1X})\log(\alpha_s) + (N_{RC} - N_{LC})\log(\alpha_c) \tag{3}$$

Figure 16:
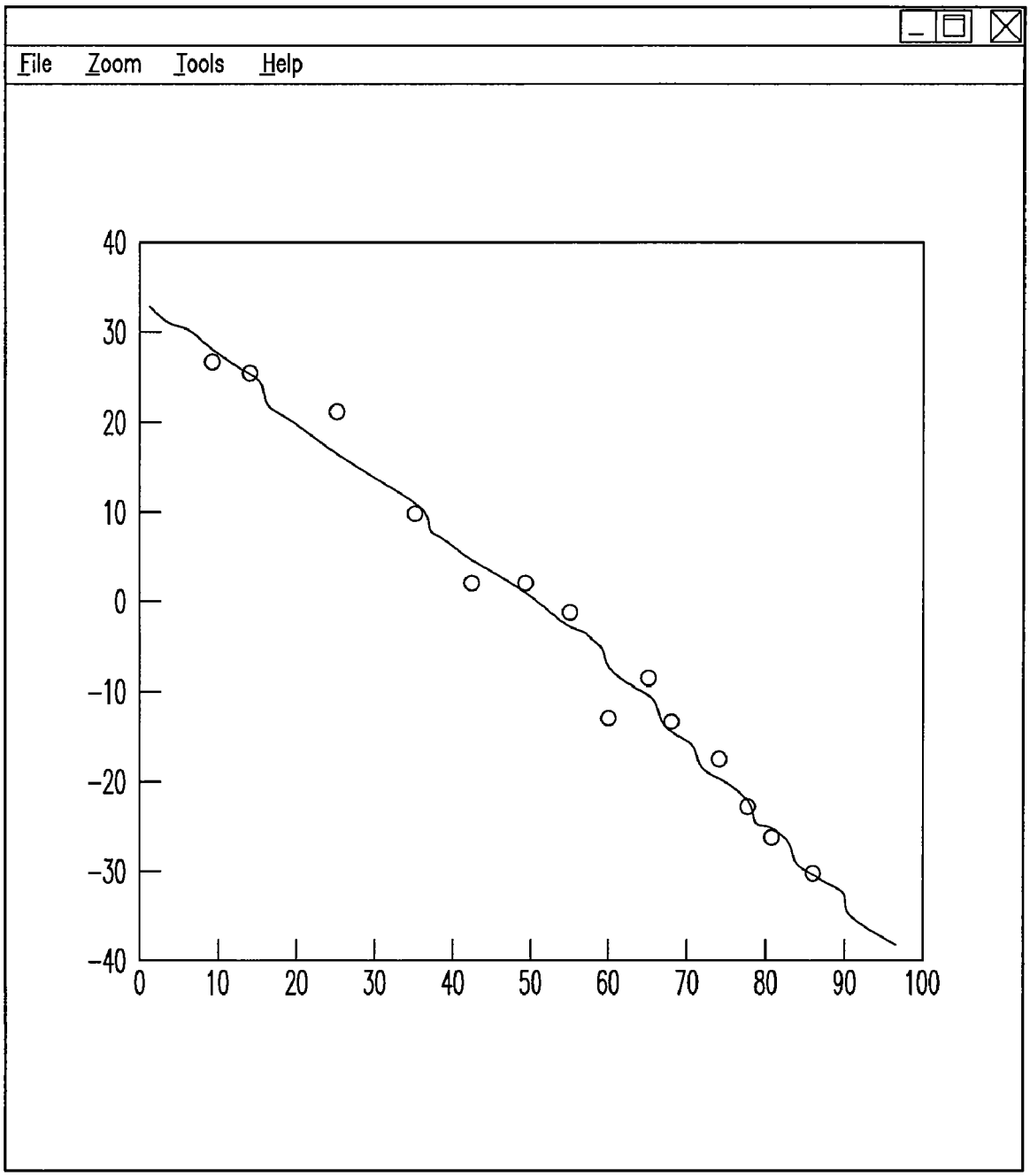
FIG. 16 shows some calibration results for our example tensioned wire attached to a chain link fence.

There are three unknowns in equation (10); "RL" sensitivity difference between the right and left channels, $\alpha_c$, and $\alpha_s$. These can be solved by using well-known least-squared error techniques given that more than 3 calibration measurements at known locations are available. Given 8 corners and 9 straight lengths of wire in our example, one should have more than a dozen calibration points with at least one in each straight length of supported wire. FIG. 16 shows some calibration results for our example tensioned wire attached to a chain link fence.

Figure 17:
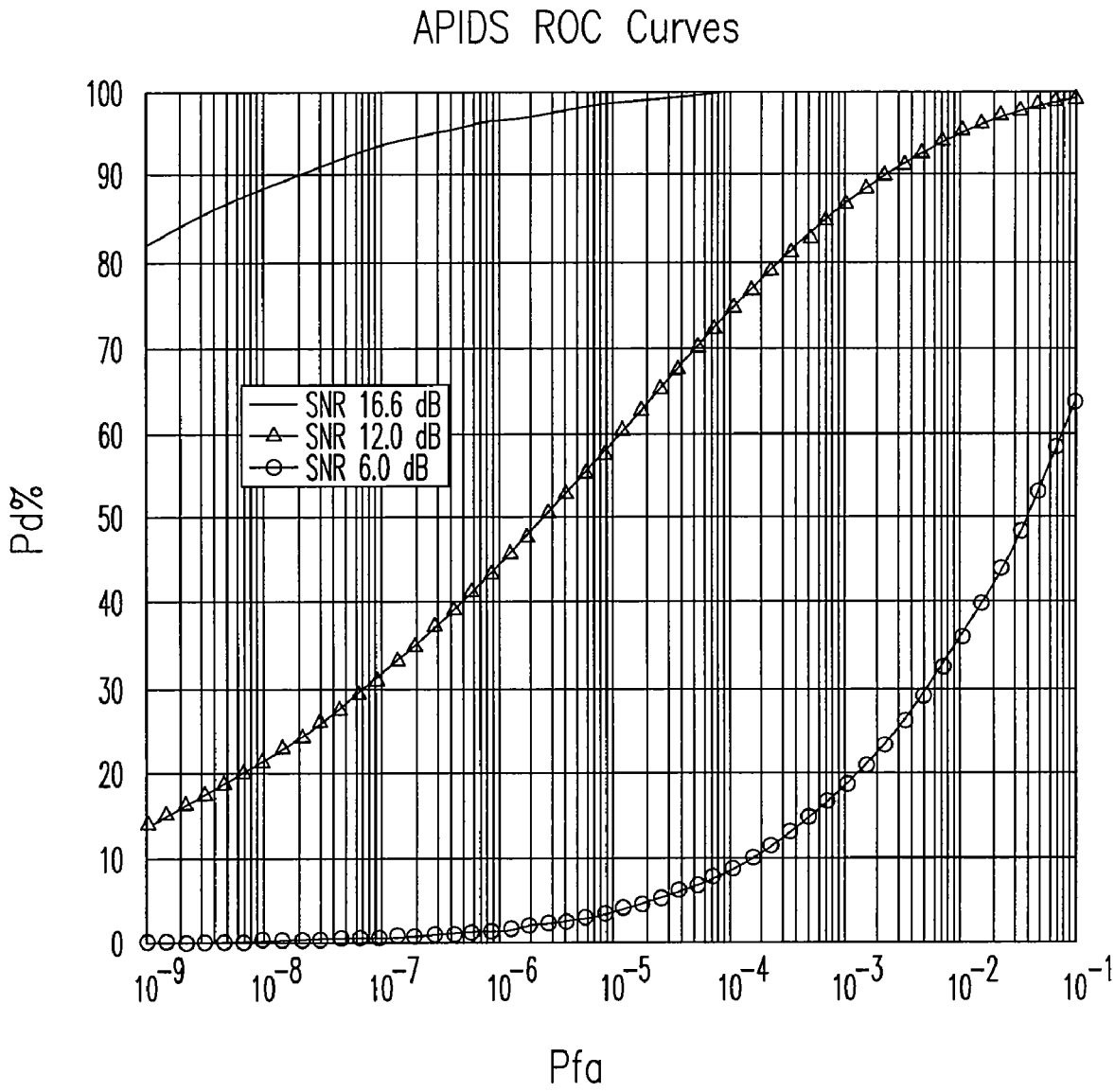
FIG. 17 shows the calculated receiver operation characteristic (ROC) curves assuming 1 second observations a standard deviation of 25 noise counts on the ADC.

FIG. 17 shows some very interesting details. The RMS ratio is shown in terms of more familiar dB ($20\times\log_{10}$) and shows a maximum loss of about 35 dB for an excitation near one end as detected at the other end. We can estimate that an excitation SNR of about 20 dB is needed near post 48 to be detectable at the two receivers at posts 1 and 96 and be localized correctly. An excitation of around 35 dB will be detected and localized correctly near the endpoints of the wire and everywhere else.

The SNR at the receivers is a bit more interesting to analyze. The SNR at each receiver and the log ratio of the right channel divided by the left channel can be used to locate the excitation, and determine the localization accuracy. For example, suppose the SNR on the right channel is 10 dB but the SNR on the left channel is 0 dB. The signal ratio of fight over left will be 10 dB, placing the excitation about post 35 in FIG. 15. However, because we don't have a detection on the left channel, the excitation location could be anywhere from post 0 to post 35, depending on the loudness of the excitation relative to the background noise. If the SNR on the right increase to 20 dB with the left SNR at 0 dB the excitation could be anywhere from post 0 to post 15. Once we have a detection on both right and left channels, we can have more confidence in the localization.

FIG. 17 shows the calculated receiver operation characteristic (ROC) curves assuming 1 second observations a standard deviation of 25 noise counts on the ADC. This is very conservative.

Based on the ROC curves in FIG. 17, if we desire less than 1 false alarm per month (Pfa=$3\times10^{-7}$) using a once per second decision, we will have an 80% Pd with an SNR of 36 dB, and practically 100% Pd for 40 dB SNR. This balances well with the fact that we need about 35 dB SNR or better for at least one receiver to accurately locate the excitation on the wire. This suggests setting a detection threshold about 90 times the noise level, and for a 16-bit data acquisition, the maximum noise level we could tolerate is around 250 ADC counts, RMS.

Combining a straightforward calibration technique and a physical model provides a process that is robust to noise variations and one the also provide physical design parameters that can be used for the design of future installations. This calibration approach provides both for impact-type calibrations as well as steady-state calibrations, such as the vibrations provided by an imbalance attached to an electric motor. The motor-based calibrations are highly reproducible.

An alternative would be to use a polynomial fit to the calibration data and generate a table that exactly matches the vibration levels to each wire attachment point. However, this approach may require skilled engineering analysis to insure good location performance throughout the wire length. This calibration would be highly specific to a given site and not generally extensible through design equations to other sites. Of course, the present invention contemplates this and other variations.

Whereas the invention has been shown and described in connection with the preferred embodiments thereof, it will be understood that many modifications, substitutions, and additions may be made which are within the intended broad scope of the following claims. For example, the present invention contemplates variations in the type of boundary used, for example, it can be a fence or can be located underground, the type of waveguide used, the number of sensors used, the type of sensors used, the control circuit used for processing, the type of processing performed, the type of transceiver if used, and other variations. These and other variations and their equivalents are within the spirit and scope of the invention.

What is claimed is:

1. A vibration detection and classifying system, comprising:

a waveguide in operative contact with a boundary;

at least one sensor for sensing vibrations operatively connected to the waveguide and providing a signal;

a control circuit operatively connected to the at least one sensor and adapted for filtering the signal into a plurality of frequency bands and detecting and classifying vibrations; and wherein the control circuit being further adapted for applying a data fusion algorithm using a separate localization position for each of the plurality of frequency bands and a separate position error range for each of the plurality of frequency bands to determine an estimated localization position and an estimated localization error.

2. The vibration detection and classification system of claim 1 wherein the control circuit is further adapted for detecting and classifying vibrations to determine if the boundary has been crossed by an intruder.

3. The vibration detection and classification system of claim 1 wherein the vibrations are acoustic waves.

4. The vibration detection and classification system of claim 1 further comprising at least one vibration coupler for coupling the waveguide to the boundary.

5. The vibration detection and classification system of claim 1 wherein the boundary includes a fence.

6. The vibration detection and classification system of claim 5 further comprising a vibration coupler operatively connected between the waveguide and the fence.

7. The vibration detection and classification system of claim 1 wherein the vibration coupler is a spring wire to reduce wind and rain noise.

8. The vibration detection and classification system of claim 1 wherein the waveguide is tensioned wire.

9. The vibration detection and classification system of claim 8 wherein the tension of the wire is less than 200 pounds.

10. The vibration detection and classification system of claim 1 wherein each of the control circuits includes a transceiver.

11. The vibration detection and classification system of claim 10 wherein the transceiver is a radio modem.

12. The vibration detection and classification system of claim 1 wherein the control circuit is adapted to classify the vibrations as being associated with a gust of wind.

13. The vibration detection and classification system of claim 1 wherein the control circuit being adapted for filtering the signal into a plurality of frequency bands to assist in classifying vibrations.

14. A vibration detection system, comprising:

a fence comprising a plurality of segments;

a plurality of sensors adapted for sensing vibrations, each sensor mechanically connected to a first of the plurality of segments and each sensor separately and mechanically connected to a second of the plurality of segments such that each sensor is adapted for sensing vibrations within the first of the plurality of segments and the second of the plurality of segments;

a control circuit operatively connected to the plurality of sensors and adapted for detecting vibrations;

wherein the control circuit being adapted for filtering the signal into a plurality of frequency bands to assist in classifying vibrations; and wherein the control circuit being further adapted for applying a data fusion algorithm using a separate localization position for each of the plurality of frequency bands and a separate position error range for each of the plurality of frequency bands to determine an estimated localization position and an estimated localization error.

15. The vibration detection system of claim 14 wherein each of the plurality of sensors comprises a spring wire operatively connected to the fence, a tension wire, and a clip operatively connected to the spring wire and the tension wire.

16. The vibration detection system of claim 14 wherein the control circuit includes a transceiver.

17. The vibration detection system of claim 14 further wherein the control circuit is adapted to classify the vibrations as being associated with a gust of wind.

18. The vibration detection system of claim 14 further comprising a computer in operative communication with the control circuit.

19. The vibration detection system of claim 18 further comprising a database in operative communication with the computer for storing a record of vibrations.

20. The vibration detection system of claim 19 further comprising at least one asset in operative communication with the control circuit for responding to vibrations.

21. The vibration detection system of claim 20 wherein the at least one asset includes a camera.

22. The vibration detection system of claim 14 further comprising an article of software adapted to assist in calibrating the vibration detection system.

23. The vibration detection system of claim 22 wherein the article of software provides for calibrating the vibration detection system by receiving from a user positions of wire corner supports and end points associated with the fence, distances between wire attachments.

24. The vibration detection of system 22 wherein the article of software further provides for recording a set of known disturbances at various points along the fence.

25. The vibration detection system of claim 14 wherein the control circuit being further adapted for determining the separate localization position for each of the plurality of frequency bands.

26. The vibration detection system of claim 25 wherein the control circuit being further adapted for determining the separate position error range for each of the plurality of frequency bands.

* * * * *